US011631421B2

(12) United States Patent
Fan et al.

(10) Patent No.: US 11,631,421 B2
(45) Date of Patent: Apr. 18, 2023

(54) APPARATUSES AND METHODS FOR ENHANCED SPEECH RECOGNITION IN VARIABLE ENVIRONMENTS

(71) Applicant: KOPIN CORPORATION, Westborough, MA (US)

(72) Inventors: Dashen Fan, Bellevue, WA (US); Xi Chen, San Jose, CA (US); Hua Bao, Santa Clara, CA (US)

(73) Assignee: SOLOS TECHNOLOGY LIMITED, Hong Kong (HK)

( * ) Notice: Subject to any disclaimer, the term of this patent is extended or adjusted under 35 U.S.C. 154(b) by 0 days.

(21) Appl. No.: 14/886,080

(22) Filed: Oct. 18, 2015

(65) Prior Publication Data

US 2017/0110142 A1 Apr. 20, 2017

(51) Int. Cl.
*G10L 21/0216* (2013.01)
*G10L 25/84* (2013.01)
*G10L 25/78* (2013.01)

(52) U.S. Cl.
CPC ..... *G10L 21/0216* (2013.01); *G10L 25/84* (2013.01); *G10L 2021/02165* (2013.01); *G10L 2025/786* (2013.01)

(58) Field of Classification Search
CPC ..... G10L 25/93; G10L 15/063; G10L 15/20; G10L 15/0208; G10L 15/22; G10L 15/16; G10L 19/005; G10L 21/0216; G10L 25/84; G10L 2021/02165; G10L 2025/786; G10K 11/1788; G10K 11/1784; H04R 5/033;

(Continued)

(56) References Cited

U.S. PATENT DOCUMENTS 3,378,649 A 4/1968 Mawby
3,789,163 A 1/1974 Dunlavy
3,919,481 A 11/1975 Kalfaian
(Continued)

FOREIGN PATENT DOCUMENTS

CN 202 102 188 1/2012
EP 2 323 422 A1 5/2011
(Continued)

OTHER PUBLICATIONS

Internation Search Report & Written Opinion for PCT/US2014/026332, Entitled "Dual Stage Noise Reduction Architecture for Desired Signal Extraction," dated Jul. 24, 2014.
(Continued)

*Primary Examiner* — Fariba Sirjani
(74) *Attorney, Agent, or Firm* — Peloquin, PLLC; Mark S. Peloquin, Esq.

(57) ABSTRACT

Systems, apparatuses, and methods are described to increase a signal-to-noise ratio difference between a main channel and reference channel. The increased signal-to-noise ratio difference is accomplished with an adaptive threshold for a desired voice activity detector (DVAD) and shaping filters. The DVAD includes averaging an output signal of a reference microphone channel to provide an estimated average background noise level. A threshold value is selected from a plurality of threshold values based on the estimated average background noise level. The threshold value is used to detect desired voice activity on a main microphone channel.

38 Claims, 14 Drawing Sheets

(58) Field of Classification Search
CPC ..... H04R 3/005; H04N 11/00; H03G 3/32; H04M 9/082
See application file for complete search history.

(56) References Cited

U.S. PATENT DOCUMENTS 3,946,168 A 3/1976 Preves
4,773,095 A 9/1988 Zwicker et al.
4,904,078 A 2/1990 Gorike
4,966,252 A 10/1990 Drever
5,657,420 A * 8/1997 Jacobs ..... H04L 1/0017 704/E19.044
5,825,898 A 10/1998 Marash
6,023,674 A * 2/2000 Mekuria ..... G10L 25/78 704/207
6,091,546 A 7/2000 Spitzer
6,266,422 B1 7/2001 Ikeda
6,349,001 B1 2/2002 Spitzer
6,678,657 B1 * 1/2004 Bruckner ..... G10L 15/20 704/233
6,694,293 B2 * 2/2004 Benyassine ..... G10L 25/78 704/229
6,707,910 B1 * 3/2004 Valve ..... G10L 25/78 342/423
7,174,022 B1 2/2007 Zhang et al.
7,359,504 B1 4/2008 Reuss et al.
7,881,927 B1 * 2/2011 Reuss ..... H04M 9/082 704/226
7,929,714 B2 4/2011 Bazarjani et al.
8,184,983 B1 5/2012 Ho et al.
8,543,061 B2 9/2013 Suhami
8,744,113 B1 6/2014 Rickards
8,958,572 B1 2/2015 Solbach
9,280,982 B1 * 3/2016 Kushner ..... G10L 21/02
2002/0106091 A1 8/2002 Furst
2002/0184015 A1 * 12/2002 Li ..... G10L 25/78 704/233
2003/0040908 A1 2/2003 Yang
2003/0147538 A1 8/2003 Elko
2003/0179888 A1 * 9/2003 Burnett ..... G10L 21/0208 381/71.8
2004/0111258 A1 6/2004 Zangi
2005/0063552 A1 3/2005 Shuttleworth
2005/0069156 A1 3/2005 Haapapuro et al.
2005/0096899 A1 * 5/2005 Padhi ..... G10L 15/10 704/216
2005/0248717 A1 11/2005 Howell et al.
2006/0020451 A1 * 1/2006 Kushner ..... B63C 11/26 704/226
2006/0217973 A1 * 9/2006 Gao ..... G10L 25/78 704/E11.003
2006/0285714 A1 12/2006 Akino
2007/0160254 A1 7/2007 Ritter et al.
2008/0137874 A1 6/2008 Christoph
2008/0249779 A1 * 10/2008 Hennecke ..... G10L 15/22 704/270
2008/0260189 A1 10/2008 Schobben
2008/0267427 A1 10/2008 Johnston
2008/0317259 A1 12/2008 Zhang et al.
2008/0317260 A1 12/2008 Short
2009/0089053 A1 * 4/2009 Wang ..... G10L 25/78 704/233
2009/0089054 A1 * 4/2009 Wang ..... H04M 9/082 704/233
2009/0112579 A1 4/2009 Li
2009/0129582 A1 5/2009 Chandran
2009/0154726 A1 * 6/2009 Taenzer ..... G10L 25/78 381/94.1
2009/0190774 A1 7/2009 Wang
2009/0299739 A1 * 12/2009 Chan ..... H04R 3/005 704/225
2010/0100386 A1 * 4/2010 Yu ..... G10L 21/0208 704/270
2010/0198590 A1 8/2010 Tackin
2010/0208928 A1 8/2010 Chene et al.
2010/0241426 A1 9/2010 Zhang
2010/0278352 A1 * 11/2010 Petit ..... G10L 21/0208 381/71.1
2010/0280824 A1 * 11/2010 Petit ..... G10L 21/0208 704/214
2011/0038489 A1 * 2/2011 Visser ..... G01S 3/8006 381/92
2011/0066429 A1 * 3/2011 Shperling ..... G10L 25/78 704/226
2011/0071825 A1 3/2011 Emori
2011/0081026 A1 * 4/2011 Ramakrishnan .... G10L 21/0208 381/94.3
2011/0091057 A1 4/2011 Derkx
2011/0099010 A1 * 4/2011 Zhang ..... G10L 21/0272 704/233
2011/0106533 A1 * 5/2011 Yu ..... G10L 25/78 704/233
2011/0243349 A1 10/2011 Zavarehei
2011/0293103 A1 * 12/2011 Park ..... G10K 11/1782 381/57
2012/0010881 A1 * 1/2012 Avendano ..... G10L 21/0272 704/226
2012/0051548 A1 * 3/2012 Visser ..... G10L 21/0208 381/56
2012/0075168 A1 3/2012 Osterhout et al.
2012/0084084 A1 * 4/2012 Zhu ..... G10L 21/0208 704/233
2012/0123773 A1 5/2012 Zeng
2012/0123775 A1 * 5/2012 Murgia ..... G10L 21/0364 704/228
2012/0162259 A1 6/2012 Sakai
2012/0209601 A1 * 8/2012 Jing ..... G10L 21/0364 704/226
2012/0215519 A1 * 8/2012 Park ..... G06F 17/289 704/2
2012/0215536 A1 * 8/2012 Sehlstedt ..... G10L 25/18 704/246
2012/0239394 A1 * 9/2012 Matsumoto ..... G10L 25/84 704/233
2012/0259631 A1 10/2012 Lloyd
2012/0282976 A1 11/2012 Suhami
2013/0030803 A1 * 1/2013 Liao ..... G10L 15/20 704/233
2013/0034243 A1 2/2013 Yermeche
2013/0142343 A1 * 6/2013 Matsui ..... G10L 21/028 381/56
2013/0314280 A1 11/2013 Maltsev et al.
2013/0332157 A1 * 12/2013 Iyengar ..... G10L 15/20 704/233
2014/0003622 A1 1/2014 Ikizyan
2014/0006019 A1 * 1/2014 Paajanen ..... G10L 21/0208 704/233
2014/0010373 A1 1/2014 Gran
2014/0056435 A1 * 2/2014 Kjems ..... H04M 9/082 381/66
2014/0081631 A1 * 3/2014 Zhu ..... G10L 21/0208 704/226
2014/0236590 A1 * 8/2014 Hu ..... G10L 21/0208 704/228
2014/0268016 A1 9/2014 Chow et al.
2014/0270244 A1 9/2014 Fan
2014/0270316 A1 9/2014 Fan
2014/0278391 A1 * 9/2014 Braho ..... G10L 25/78 704/233
2014/0337021 A1 * 11/2014 Kim ..... G10L 21/0208 704/228
2014/0358526 A1 * 12/2014 Abdelal ..... G10L 25/30 704/202
2015/0012269 A1 1/2015 Nakadai
2015/0032451 A1 * 1/2015 Gunn ..... G10L 15/063 704/244
2015/0106088 A1 * 4/2015 Jarvinen ..... G10L 21/0208 704/233
2015/0172807 A1 * 6/2015 Olsson ..... G10K 11/175 381/74

(56) References Cited

U.S. PATENT DOCUMENTS

| | | | | |
|---|---|---|---|---|
| 2015/0215700 | A1* | 7/2015 | Sun | G10L 21/0232 381/94.2 |
| 2015/0221322 | A1* | 8/2015 | Iyengar | G10L 25/84 704/226 |
| 2015/0230023 | A1* | 8/2015 | Fujieda | G10L 21/0208 381/71.1 |
| 2015/0262590 | A1* | 9/2015 | Joder | G10L 21/0232 704/201 |
| 2015/0262591 | A1* | 9/2015 | Hill | G10L 25/78 704/233 |
| 2015/0269954 | A1* | 9/2015 | Ryan | G10L 25/78 704/233 |
| 2015/0287406 | A1* | 10/2015 | Kristjansson | G10L 21/0232 704/233 |
| 2015/0294674 | A1* | 10/2015 | Takahashi | G10L 25/78 704/226 |
| 2015/0318902 | A1* | 11/2015 | Sugiyama | G10L 21/0232 375/150 |
| 2016/0005422 | A1* | 1/2016 | Zad Issa | G10L 25/84 704/226 |
| 2016/0029121 | A1* | 1/2016 | Nesta | G10L 19/008 381/71.1 |

FOREIGN PATENT DOCUMENTS

| | | | |
|---|---|---|---|
| EP | 2 469 323 | A1 | 6/2012 |
| JP | 58013008 | A | 1/1983 |
| JP | 06-338827 | A | 12/1994 |
| JP | 06338827 | A | 12/1994 |
| JP | 9252340 | | 9/1997 |
| JP | 10-301600 | A | 11/1998 |
| JP | 10301600 | A | 11/1998 |
| JP | 2003-271191 | A | 9/2003 |
| JP | 2011015018 | A | 1/2011 |
| KR | 10-0857822 | B1 | 9/2008 |
| KR | 10-0936772 | B1 | 1/2010 |
| WO | WO 2000/02419 | | 1/2000 |
| WO | WO 2009/076016 | | 6/2009 |
| WO | WO 2011/087770 | A2 | 7/2011 |
| WO | WO 2012/040386 | | 3/2012 |
| WO | WO 2012/097014 | A1 | 7/2012 |
| WO | WO 2014/158426 | A1 | 10/2014 |
| WO | WO 2014/163794 | A2 | 10/2014 |
| WO | WO 2014/163796 | A1 | 10/2014 |
| WO | WO 2014/163797 | A1 | 10/2014 |

OTHER PUBLICATIONS

Internation Search Report & Written Opinion for PCT/US2014/028605, Entitled "Apparatuses and Methods for Multi-Channel Signal Compression During Desired . . . ," dated Jul. 24, 2014.

International Search Report & Written Opinion for PCT/US2014/026332, Entitled "Apparatuses and Methods for Acoustic Channel Auto-Balancing During Mult- . . . ," dated Jul. 30, 2014.

Zhang, Xianxian, Noise Estimation Based on an Adaptive Smoothing Factor for Improving Speech Quality in a Dual-Microphone Noise-Suppression System, 2011, IEEE, 5 PGS, US.

Internation Search Report & Written Opinion, PCT/US2014/016547, Entitled, "Sound Induction Ear Speaker for Eye Glasses," dated Apr. 29, 2014 (15 pages).

Internation Search Report & Written Opinion, PCT/US2014/016557, Entitled, "Sound Induction Ear Speaker for Eye Glasses," dated Sep. 24, 2014 (15 pages).

Internation Search Report & Written Opinion, PCT/US2014/016558, Entitled, "Eye Glasses With Microphone Array" dated Jun. 12, 2014 (12 pages).

Internation Search Report & Written Opinion, PCT/US2014/016570, Entitled, "Noise Cancelling Microphone Apparatus," Jun. 25, 2014 (19 pages).

* cited by examiner

APPARATUSES AND METHODS FOR ENHANCED SPEECH RECOGNITION IN VARIABLE ENVIRONMENTS

BACKGROUND OF THE INVENTION

1. Field of Invention

The invention relates generally to detecting and processing acoustic signal data and more specifically to reducing noise in acoustic systems.

2. Art Background

Acoustic systems employ acoustic sensors such as microphones to receive audio signals. Often, these systems are used in real world environments which present desired audio and undesired audio (also referred to as noise) to a receiving microphone simultaneously. Such receiving microphones are part of a variety of systems such as a mobile phone, a handheld microphone, a hearing aid, etc. These systems often perform speech recognition processing on the received acoustic signals. Simultaneous reception of desired audio and undesired audio have a negative impact on the quality of the desired audio. Degradation of the quality of the desired audio can result in desired audio which is output to a user and is hard for the user to understand. Degraded desired audio used by an algorithm such as in speech recognition (SR) or Automatic Speech Recognition (ASR) can result in an increased error rate which can render the reconstructed speech hard to understand. Either of which presents a problem.

Undesired audio (noise) can originate from a variety of sources, which are not the source of the desired audio. Thus, the sources of undesired audio are statistically uncorrelated with the desired audio. The sources can be of a non-stationary origin or from a stationary origin. Stationary applies to time and space where amplitude, frequency, and direction of an acoustic signal do not vary appreciably. For example, in an automobile environment engine noise at constant speed is stationary as is road noise or wind noise, etc. In the case of a non-stationary signal, noise amplitude, frequency distribution, and direction of the acoustic signal vary as a function of time and or space. Non-stationary noise originates for example, from a car stereo, noise from a transient such as a bump, door opening or closing, conversation in the background such as chit chat in a back seat of a vehicle, etc. Stationary and non-stationary sources of undesired audio exist in office environments, concert halls, football stadiums, airplane cabins, everywhere that a user will go with an acoustic system (e.g., mobile phone, tablet computer etc. equipped with a microphone, a headset, an ear bud microphone, etc.) At times the environment that the acoustic system is used in is reverberant, thereby causing the noise to reverberate within the environment, with multiple paths of undesired audio arriving at the microphone location. Either source of noise, i.e., non-stationary or stationary undesired audio, increases the error rate of speech recognition algorithms such as SR or ASR or can simply make it difficult for a system to output desired audio to a user which can be understood. All of this can present a problem.

Various noise cancellation approaches have been employed to reduce noise from stationary and non-stationary sources. Existing noise cancellation approaches work better in environments where the magnitude of the noise is less than the magnitude of the desired audio, e.g., in relatively low noise environments. Spectral subtraction is used to reduce noise in speech recognition algorithms and in various acoustic systems such as in hearing aids. Systems employing Spectral Subtraction do not produce acceptable error rates when used in Automatic Speech Recognition (ASR) applications when a magnitude of the undesired audio becomes large. This can present a problem.

Various methods have been used to try to suppress or remove undesired audio from acoustic systems, such as in Speech Recognition (SR) or Automatic Speech Recognition (ASR) applications for example. One approach is known as a Voice Activity Detector (VAD). A VAD attempts to detect when desired speech is present and when undesired audio is present. Thereby, only accepting desired speech and treating as noise by not transmitting the undesired audio. Traditional voice activity detection only works well for a single sound source or a stationary noise (undesired audio) whose magnitude is small relative to the magnitude of the desired audio. Therefore, traditional voice activity detection renders a VAD a poor performer in a noisy environment. Additionally, using a VAD to remove undesired audio does not work well when the desired audio and the undesired audio are arriving simultaneously at a receive microphone. This can present a problem.

In dual microphone VAD systems, an energy level ratio between a main microphone and a reference microphone is compared with a preset threshold to determine when desired voice activity is present. If the energy level ratio is greater than the preset threshold, then desired voice activity is detected. If the energy level ratio does not exceed the preset threshold then desired audio is not detected. When the background level of the undesired audio changes a preset threshold can either fail to detect desired voice activity or undesired audio can be accepted as desired voice activity. In either case, the system's ability to properly detect desired voice activity is diminished, thereby negatively effecting system performance. This can present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described for detecting and processing acoustic signals containing both desired audio and undesired audio. In one or more embodiments, apparatuses and methods are described which increase the performance of noise cancellation systems by increasing the signal-to-noise ratio difference between multiple channels and adaptively changing a threshold value of a voice activity detector based on the background noise of the environment.

Figure 1:
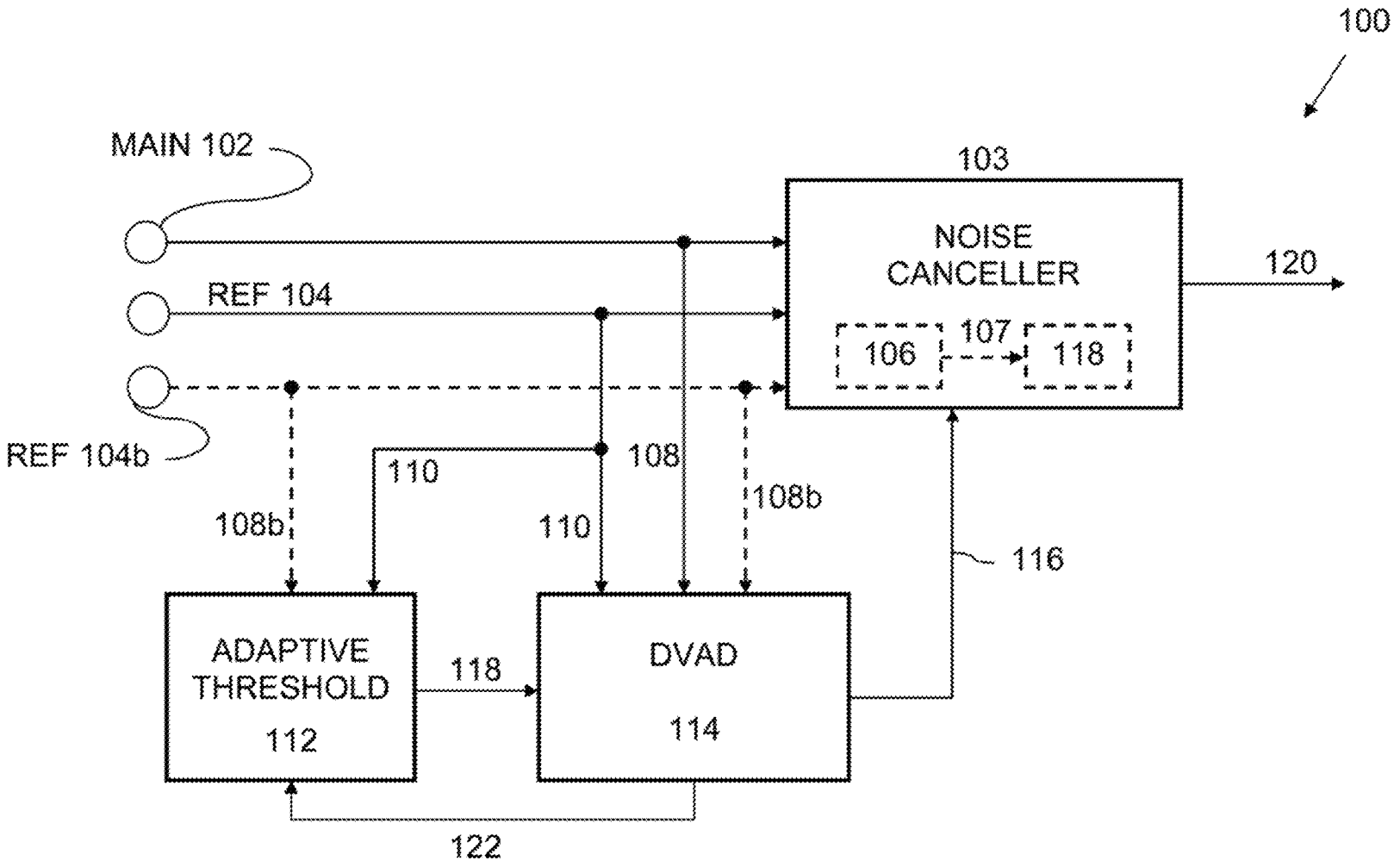
FIG. 1 illustrates system architecture, according to embodiments of the invention.

FIG. 1 illustrates, generally at 100, system architecture, according to embodiments of the invention. With reference to FIG. 1, two acoustic channels are input into a noise cancellation module 103. A first acoustic channel, referred to herein as main channel 102, is referred to in this description of embodiments synonymously as a "primary" or a "main" channel. The main channel 102 contains both desired audio and undesired audio. The acoustic signal input on the main channel 102 arises from the presence of both desired audio and undesired audio on one or more acoustic elements as described more fully below in the figures that follow. Depending on the configuration of a microphone or microphones used for the main channel the microphone elements can output an analog signal. The analog signal is converted to a digital signal with an analog-to-digital converter (ADC) (not shown). Additionally, amplification can be located proximate to the microphone element(s) or ADC. A second acoustic channel, referred to herein as reference channel 104 provides an acoustic signal which also arises from the presence of desired audio and undesired audio. Optionally, a second reference channel 104*b* can be input into the noise cancellation module 103. Similar to the main channel and depending on the configuration of a microphone or microphones used for the reference channel, the microphone elements can output an analog signal. The analog signal is converted to a digital signal with an analog-to-digital converter (ADC) (not shown). Additionally, amplification can be located proximate to the microphone element(s) or AD converter.

In some embodiments, the main channel 102 has an omni-directional response and the reference channel 104 has an omni-directional response. In some embodiments, the acoustic beam patterns for the acoustic elements of the main channel 102 and the reference channel 104 are different. In other embodiments, the beam patterns for the main channel 102 and the reference channel 104 are the same; however, desired audio received on the main channel 102 is different from desired audio received on the reference channel 104. Therefore, a signal-to-noise ratio for the main channel 102 and a signal-to-noise ratio for the reference channel 104 are different. In general, the signal-to-noise ratio for the reference channel is less than the signal-to-noise-ratio of the main channel. In various embodiments, by way of non-limiting examples, a difference between a main channel signal-to-noise ratio and a reference channel signal-to-noise ratio is approximately 1 or 2 decibels (dB) or more. In other non-limiting examples, a difference between a main channel signal-to-noise ratio and a reference channel signal-to-noise ratio is 1 decibel (dB) or less. Thus, embodiments of the invention are suited for high noise environments, which can result in low signal-to-noise ratios with respect to desired audio as well as low noise environments, which can have higher signal-to-noise ratios. As used in this description of embodiments, signal-to-noise ratio means the ratio of desired audio to undesired audio in a channel. Furthermore, the term "main channel signal-to-noise ratio" is used interchangeably with the term "main signal-to-noise ratio." Similarly, the term "reference channel signal-to-noise ratio" is used interchangeably with the term "reference signal-to-noise ratio."

The main channel 102, the reference channel 104, and optionally a second reference channel 104*b* provide inputs to the noise cancellation module 103. While an optional second reference channel is shown in the figures, in various embodiments, more than two reference channels are used. In some embodiments, the noise cancellation module 103 includes an adaptive noise cancellation unit 106 which filters undesired audio from the main channel 102, thereby providing a first stage of filtering with multiple acoustic channels of input. In various embodiments, the adaptive noise cancellation unit 106 utilizes an adaptive finite impulse response (FIR) filter. The environment in which embodiments of the invention are used can present a reverberant acoustic field. Thus, the adaptive noise cancellation unit 106 includes a delay for the main channel sufficient to approximate the impulse response of the environment in which the system is used. A magnitude of the delay used will vary depending on the particular application that a system is designed for including whether or not reverberation must be considered in the design. In some embodiments, for microphone channels positioned very closely together (and where reverberation is not significant) a magnitude of the delay can be on the order of a fraction of a millisecond. Note that at the low end of a range of values, which could be used for a delay, an acoustic travel time between channels can represent a minimum delay value. Thus, in various embodiments, a delay value can range from approximately a fraction of a millisecond to approximately 500 milliseconds or more depending on the application.

An output 107 of the adaptive noise cancellation unit 106 is input into a single channel noise cancellation unit 118. The single channel noise cancellation unit 118 filters the output 107 and provides a further reduction of undesired audio from the output 107, thereby providing a second stage of filtering. The single channel noise cancellation unit 118 filters mostly stationary contributions to undesired audio. The single channel noise cancellation unit 118 includes a linear filter, such as for example a Wiener filter, a Minimum Mean Square Error (MMSE) filter implementation, a linear stationary noise filter, or other Bayesian filtering approaches which use prior information about the parameters to be estimated. Further description of the adaptive noise cancellation unit 106 and the components associated therewith and the filters used in the single channel noise cancellation unit 118 are described in U.S. Pat. No. 9,633,670 B2, titled DUAL STAGE NOISE REDUCTION ARCHITECTURE FOR DESIRED SIGNAL EXTRACTION, which is hereby incorporated by reference. In addition, the implementation and operation of other components of the filter control such as the main channel activity detector, the reference channel activity detector and the inhibit logic are described more fully in U.S. Pat. No. 7,386,135 titled "Cardioid Beam With A Desired Null Based Acoustic Devices, Systems and Methods," which is hereby incorporated by reference.

Acoustic signals from the main channel 102 are input at 108 into a filter control which includes a desired voice activity detector 114. Similarly, acoustic signals from the reference channel 104 are input at 110 into the desired voice activity detector 114 and into adaptive threshold module 112. An optional second reference channel is input at 108*b* into desired voice activity detector 114 and into adaptive threshold module 112. The desired voice activity detector 114 provides control signals 116 to the noise cancellation module 103, which can include control signals for the adaptive noise cancellation unit 106 and the single channel noise cancellation unit 118. The desired voice activity detector 114 provides a signal at 122 to the adaptive threshold module 112. The signal 122 indicates when desired voice activity is present and not present. In one or more embodiments a logical convention is used wherein a "1" indicates voice activity is present and a "0" indicates voice activity is not present. In other embodiments other logical conventions can be used for the signal 122.

The adaptive threshold module 112 includes a background noise estimation module and selection logic which provides a threshold value which corresponds to a given estimated average background noise level. A threshold value corresponding to an estimated average background noise level is passed at 118 to the desired voice activity detector 114. The threshold value is used by the desired voice activity detector 114 to determine when voice activity is present.

In various embodiments, the operation of adaptive threshold module 112 is described more completely below in conjunction with the figures that follow. An output 120 of the noise cancellation module 103 provides an acoustic signal which contains mostly desired audio and a reduced amount of undesired audio.

The system architecture shown in FIG. 1 can be used in a variety of different systems used to process acoustic signals according to various embodiments of the invention. Some examples of the different acoustic systems are, but are not limited to, a mobile phone, a handheld microphone, a boom microphone, a microphone headset, a hearing aid, a hands free microphone device, a wearable system embedded in a frame of an eyeglass, a near-to-eye (NTE) headset display or headset computing device, any wearable device, etc. The environments that these acoustic systems are used in can have multiple sources of acoustic energy incident upon the acoustic elements that provide the acoustic signals for the main channel 102 and the reference channel 104 as well as optional channels 104*b*. In various embodiments, the desired audio is usually the result of a user's own voice. In various embodiments, the undesired audio is usually the result of the combination of the undesired acoustic energy from the multiple sources that are incident upon the acoustic elements used for both the main channel and the reference channel. Thus, the undesired audio is statistically uncorrelated with the desired audio.

Figure 2:
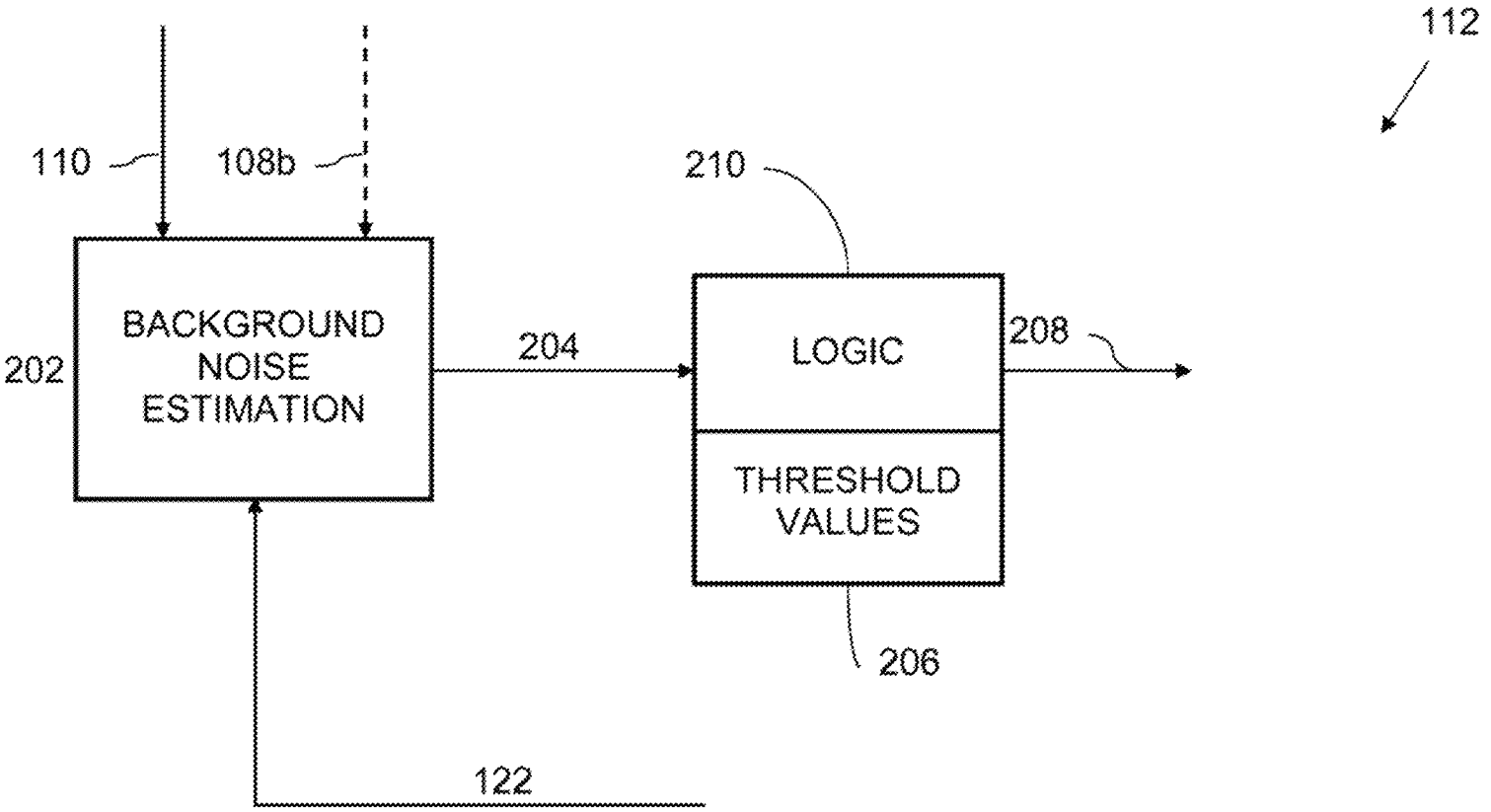
FIG. 2 illustrates a filter control/adaptive threshold module, according to embodiments of the invention.

FIG. 2 illustrates, generally at 112, an adaptive threshold module, according to embodiments of the invention. With reference to FIG. 2, a background noise estimation module 202 receives a reference acoustic signal 110 and one or more optional additional reference acoustic signals represented by 108*b*. A signal 122 from a desired voice activity detector (e.g., such as 114 in FIG. 1 or 814 in FIG. 8 below) provides a signal to the background noise estimation module which indicates when voice activity is present or not present. When voice activity is not present, the background noise estimation module 202 averages the background noise from 110 and 108*b* to provide an estimated average background noise level at 204 to selection logic 210. Selection logic 210 selects a threshold value which corresponds to the estimated average background noise level passed at 204. An association of various estimated average background noise levels has been previously made with the threshold values 206 by means of empirical measurements. The selection logic 210 together with the threshold values 206 provide a threshold value at 208 which adapts to the estimated average background noise level measured by the system. The threshold value 208 is provided to a desired voice activity detector, such as 114 in FIG. 1 or elsewhere in the figures that follow for use in detecting when desired voice activity is present.

In operation, the amplitude of the reference signals 110/108*b* will vary depending on the noise environment that the system is used in. For example, in a quiet environment, such as in some office settings, the background noise will be lower than for example in some outdoor environments subject to for example road noise or the noise generated at a construction site. In such varying environments, a different background noise level will be estimated by 202 and different threshold values will be selected by selection logic 210 based on the estimated average background noise level. The relationship between background noise level and threshold value is discussed more fully below in conjunction with FIG. 5.

Figure 3:
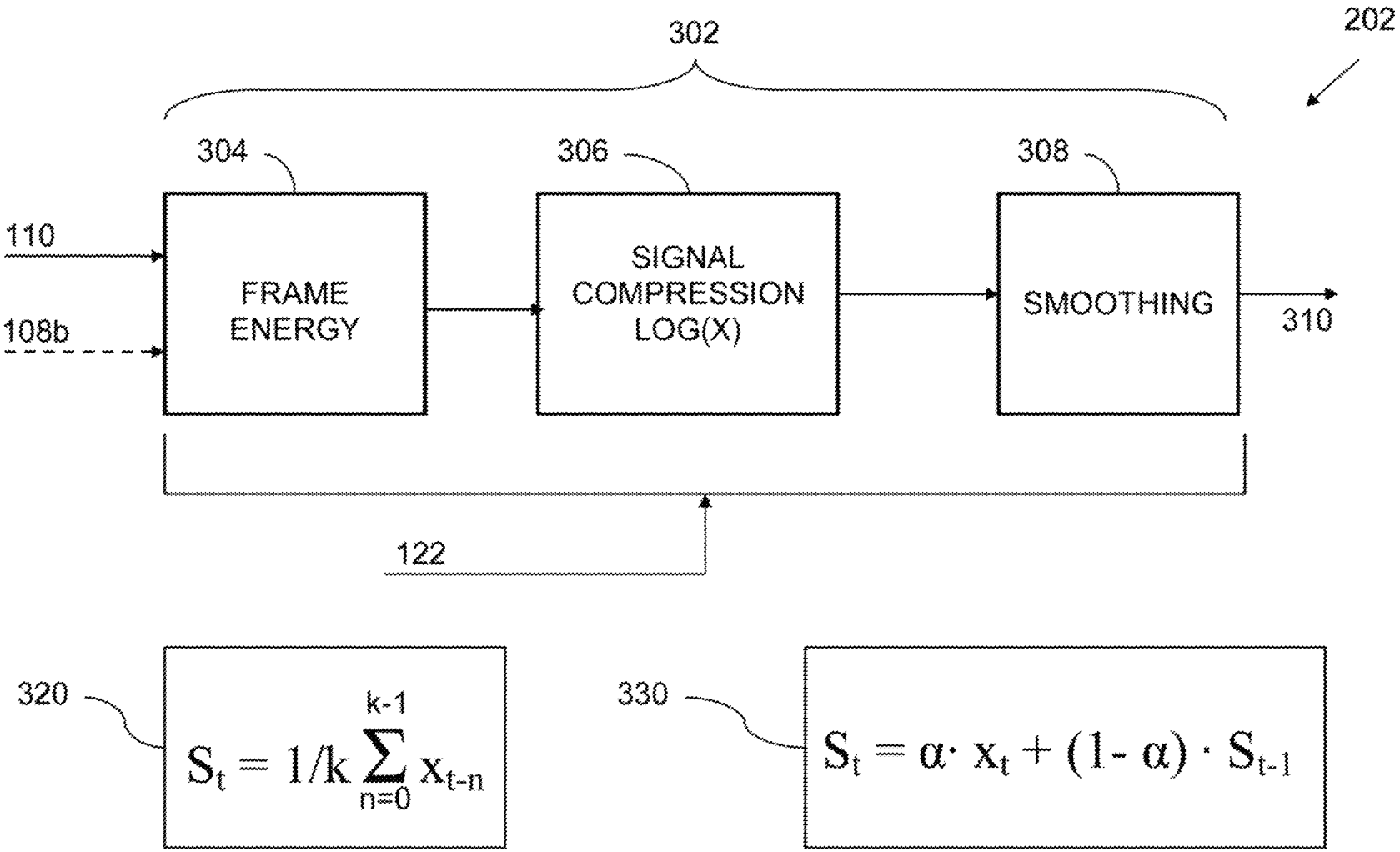
FIG. 3 illustrates a background noise estimation module, according to embodiments of the invention.

FIG. 3 illustrates, generally at 202, a background noise estimation module, according to embodiments of the invention. With reference to FIG. 3, a reference microphone signal 110 is input to a buffer 304. Optionally one or more additional reference microphones are input to the buffer 304 as represented by 108*b*. The buffer 304 can be configured in different ways to accept different amounts of data. In one or more embodiments the buffer 304 processes one frame of data at a time. The energy represented by the frame of data can be calculated in various ways. In one example, the frame energy is obtained by squaring the amplitude of each sample and then summing the absolute value of each squared sample in the frame. The frame energy is compressed at a signal compressor 306 where the energy is scaled to a different range. Different (scaling) compression functions can be applied at the signal compressor 306. For example, Log base 10 compression can be used where the compressed value $Y=\log_{10}(X)$. In another example, Log base 2 compression can be used where $Y=\log_2(X)$. In yet another example, natural log compression can be used where $Y=\ln(X)$. A user defined compression can also be implemented as desired to provide more or less compression where $Y=f(X)$, where f represents a user supplied function.

The compressed data is smoothed by a smoothing stage 308 where the high frequency fluctuations are reduced. In various embodiments different smoothing can be applied. In one embodiment, smoothing is accomplished by a simple moving average, as shown by an equation 320. In another embodiment, smoothing is accomplished by an exponential moving average as shown by an equation 330. The smoothed frame energy is output at 310 as the estimated average background energy level which used by selection logic to select a threshold value that corresponds to the estimated average background energy level as described above in conjunction with FIG. 2. The estimated average background energy level is only calculated and updated across 302 when voice activity is not present, which in some logical implementations occurs when the signal 122 is at zero.

Figure 4A:
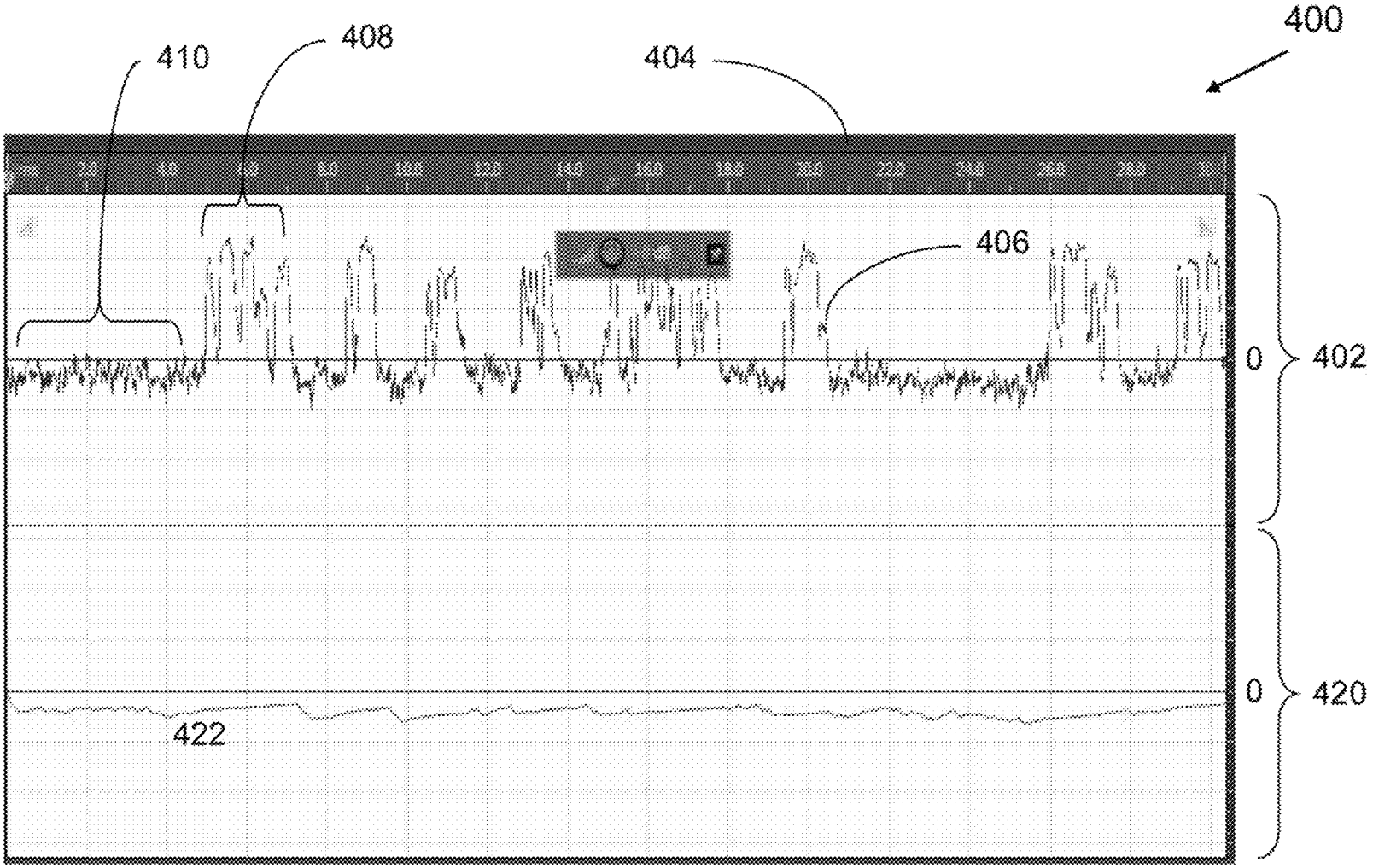
FIG. 4A illustrates a 75 dB background noise measurement, according to embodiments of the invention.
Figure 4B:
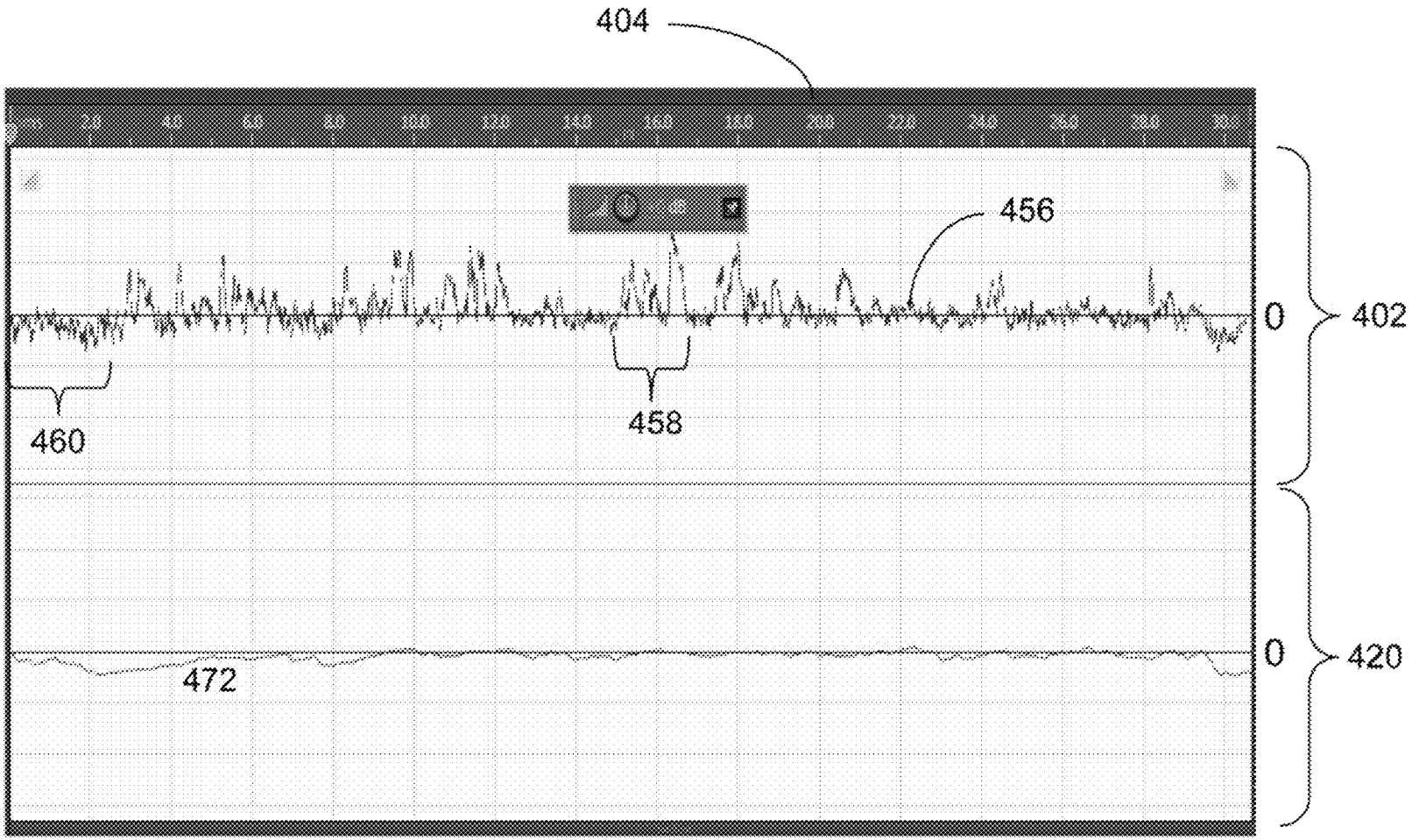
FIG. 4B illustrates a 90 dB background noise measurement, according to embodiments of the invention.

FIG. 4A illustrates, generally at 400, a 75 dB (decibel) background noise measurement, according to embodiments of the invention. With reference to FIG. 4A, a main microphone signal 406 is displayed with amplitude on the vertical axis 402 and time on the horizontal axis 404. The time record displayed in FIG. 4A represents approximately 30 seconds on data and the units associated with vertical axis are decibels. The figures FIG. 4A and FIG. 4B are provided for relative amplitude comparison therebetween on vertical axes having the same absolute range; however neither the absolute scale nor the decibels per division are indicated thereon for clarity in presentation. Referring back to FIG. 4A, the main microphone signal 406 was acquired with intermittent speech spoken in the presence of a background noise level of 75 dB. The main microphone signal 406 includes segments of voice activity such as for example 408, and sections of no voice activity, such as for example 410. Only 408 and 410 have been marked as such to preserve clarity in the illustration.

An estimate of the average estimated background noise level is plotted at 422 with vertical scale 420 plotted with units of dB. The average estimated background noise level 422 has been estimated using the teachings presented above in conjunction with the preceding figures. Note that in the case of FIG. 4A and FIG. 4B the main microphone signal has been processed to produce the estimated average background noise level. This is an alternative embodiment relative to processing the reference microphone signal in order to obtain an estimated average background noise level.

FIG. 4B illustrates, generally at 450, a 90 dB background noise measurement, according to embodiments of the invention. With reference to FIG. 4B, an increased background noise level of 90 dB (increased from 75 dB used in FIG. 4A) was used as a background level when speech was spoken. A main microphone signal 456 includes segments of voice activity such as for example 458, and sections of no voice activity, such as for example 460. Only 458 and 460 have been marked as such to preserve clarity in the illustration. An estimate of the average estimated background noise level is plotted at 472 with vertical scale 420 plotted with units of dB. The average estimated background noise level 472 has been estimated using the teachings presented above in conjunction with the preceding figures.

Visual comparison of 422 (FIG. 4A) with 472 (FIG. 4B) indicate that the amplitude of 472 is greater than the amplitude of 422, noting that the average estimated background noise level has moved in the vertical direction representing an increase in level, which is consistent with a 90 dB background noise level being greater than a 75 dB background noise level. Different speech signals were collected during the measurement of FIG. 4A verses the measurement of FIG. 4B, therefore the segments of voice activity are different in each plot.

Figure 5:
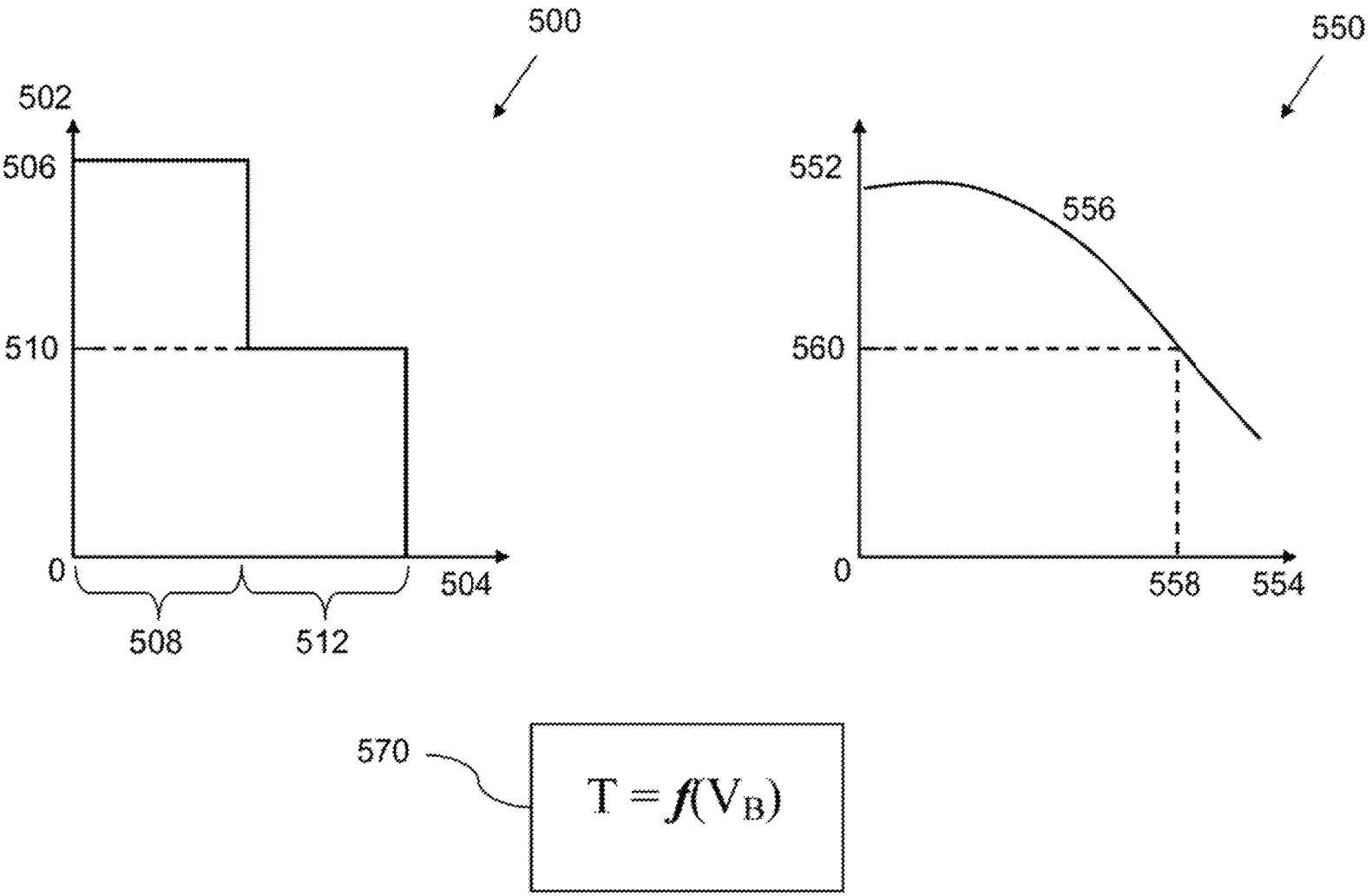
FIG. 5 illustrates threshold value as a function of background noise level according to embodiments of the invention.

FIG. 5 illustrates threshold value as a function of background noise level according to embodiments of the invention. With reference to FIG. 5, in a plot shown at 500, two different threshold values have been plotted as a function of average estimated background noise level. Increasing threshold value is indicated on a vertical axis at 502 increasing noise level is indicated on a horizontal axis at 504. A first threshold value indicated at 506 is used for a range of estimated average noise level shown at 508. A second threshold value 510 is used for a range of estimated average noise level shown at 512. Note that as the estimated average noise level increases the threshold value decreases. Underlying this system behavior is the observation that a difference in signal-to-noise ratio (between the main and reference microphones) is greater when the background noise level is lower and the difference in signal-to-noise ratio decreases as the background noise level increases.

With reference to FIG. 5, in a plot shown at 550, a continuous variation in threshold value is plotted as a function of estimated average background noise level at 556. In the plot shown at 550, threshold value is plotted on the vertical axis at 552 and noise level is plotted on the horizontal axis at 554. Any threshold value corresponding to an estimated average background noise level is obtained from the curve 556 such as for example a threshold value 560 corresponding with an average estimated background noise level 558. A relationship between threshold value "T" and estimated average background noise level $V_B$ is shown qualitatively by equation 570 where $f(V_B)$ is defined by the functional relationship illustrated in the plot at 550 by the curve 556. At each background noise level, the threshold value is selected which provides the greatest accuracy for the speech recognition test.

The associations of threshold value and estimated average background noise level, embodiments of which are illustrated in FIG. 5, are obtained empirically in a variety of ways. In one embodiment, the association is created by operating a noise cancellation system at different known levels of background noise and establishing threshold values which provide enhanced noise cancellation operation. This can be done in various ways such as by testing the accuracy of speech recognition on a set of test words as a function of threshold value for fixed background noise level and then repeating over a range of background noise level.

Once the threshold values are obtained and their association with background noise levels established, the threshold values are stored and are available for use by the data processing system. For example, in one or more embodiments, the threshold values are stored in a look-up table at 206 (FIG. 2) or a functional relationship 570 (FIG. 5) can be provided at 206 (FIG. 2). In either case, logic (such as selection logic 210 in FIG. 2) retrieves a threshold value corresponding to a given estimated average background noise level for use during noise cancellation.

Implementation of an adaptive threshold for the desired voice detection circuit enables a data processing system employing such functionality to operate over a greater range of background noise operating conditions ranging from a quiet whisper to loud construction noise. Such functionality improves the accuracy of the voice recognition and decreases a speech recognition error rate.

Figure 6:
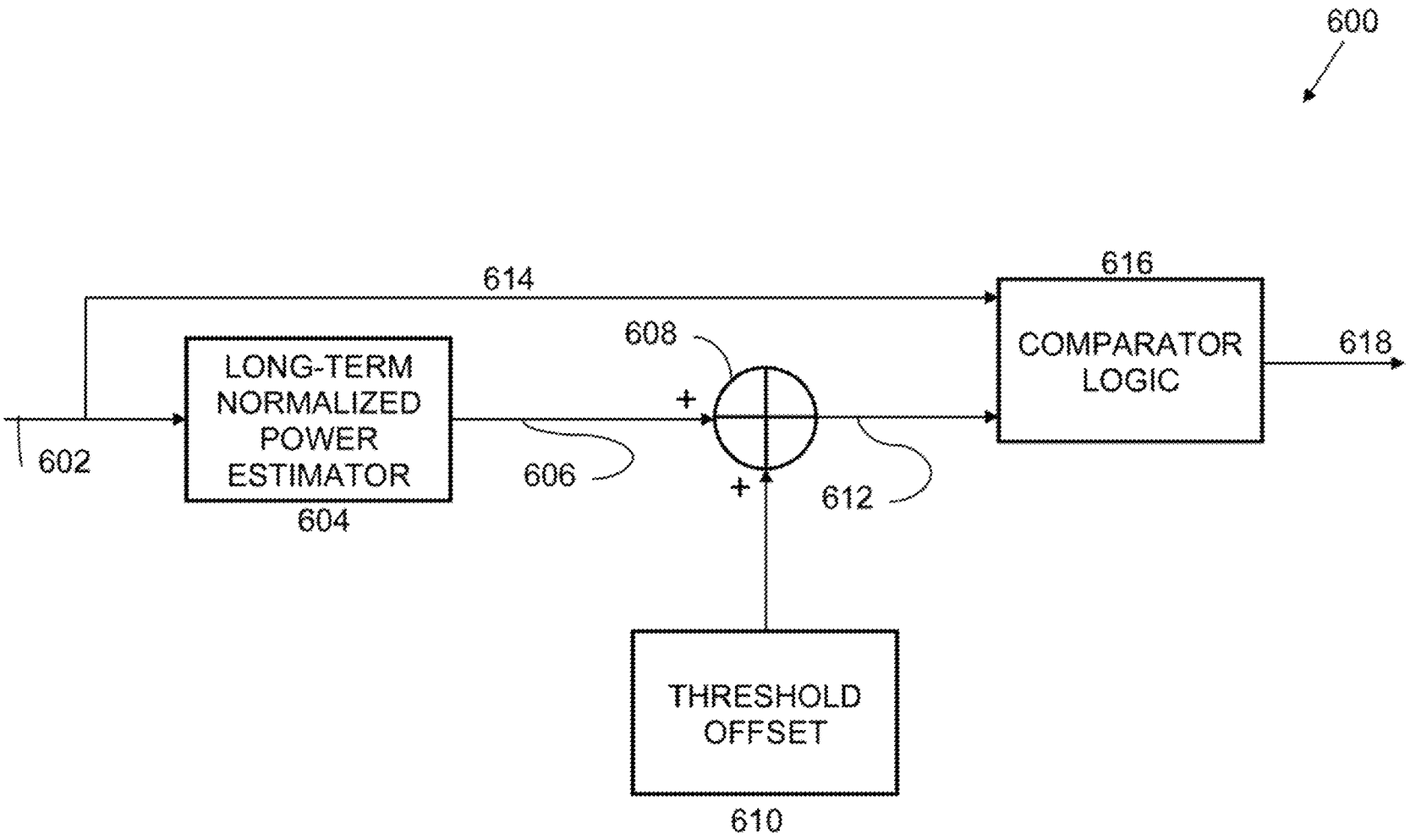
FIG. 6 illustrates an adaptive threshold applied to voice activity detection according to embodiments of the invention.

FIG. 6 illustrates, generally at 600, an adaptive threshold applied to voice activity detection, according to embodiments of the invention. With reference to FIG. 6, a portion of a desired voice activity detector is described in conjunction with the operation of an adaptive threshold circuit. In one embodiment, a normalized main signal 602, obtained from the desired voice activity detector, is input into a long-term normalized power estimator 604. The long-term normalized power estimator 604 provides a running estimate of the normalized main signal 602. The running estimate provides a floor for desired audio. An offset value 610 is added in an adder 608 to a running estimate of the output of the long-term normalized power estimator 604. The output of the adder 612 is input to comparator 616. An instantaneous estimate 614 of the normalized main signal 602 is input to the comparator 616. The comparator 616 contains logic that compares the instantaneous value at 614 to the running ratio plus offset at 612. If the value at 614 is greater than the value at 612, desired audio is detected and a flag is set accordingly and transmitted as part of the normalized desired voice activity detection signal 618. If the value at 614 is less than the value at 612 desired audio is not detected and a flag is set accordingly and transmitted as part of the normalized desired voice activity detection signal 618. The long-term normalized power estimator 604 averages the normalized main signal 602 for a length of time sufficiently long in order to slow down the change in amplitude fluctuations. Thus, amplitude fluctuations are slowly changing at 606. The averaging time can vary from a fraction of a second to minutes, by way of non-limiting examples. In various embodiments, an averaging time is selected to provide slowly changing amplitude fluctuations at the output of 606.

Figure 8:
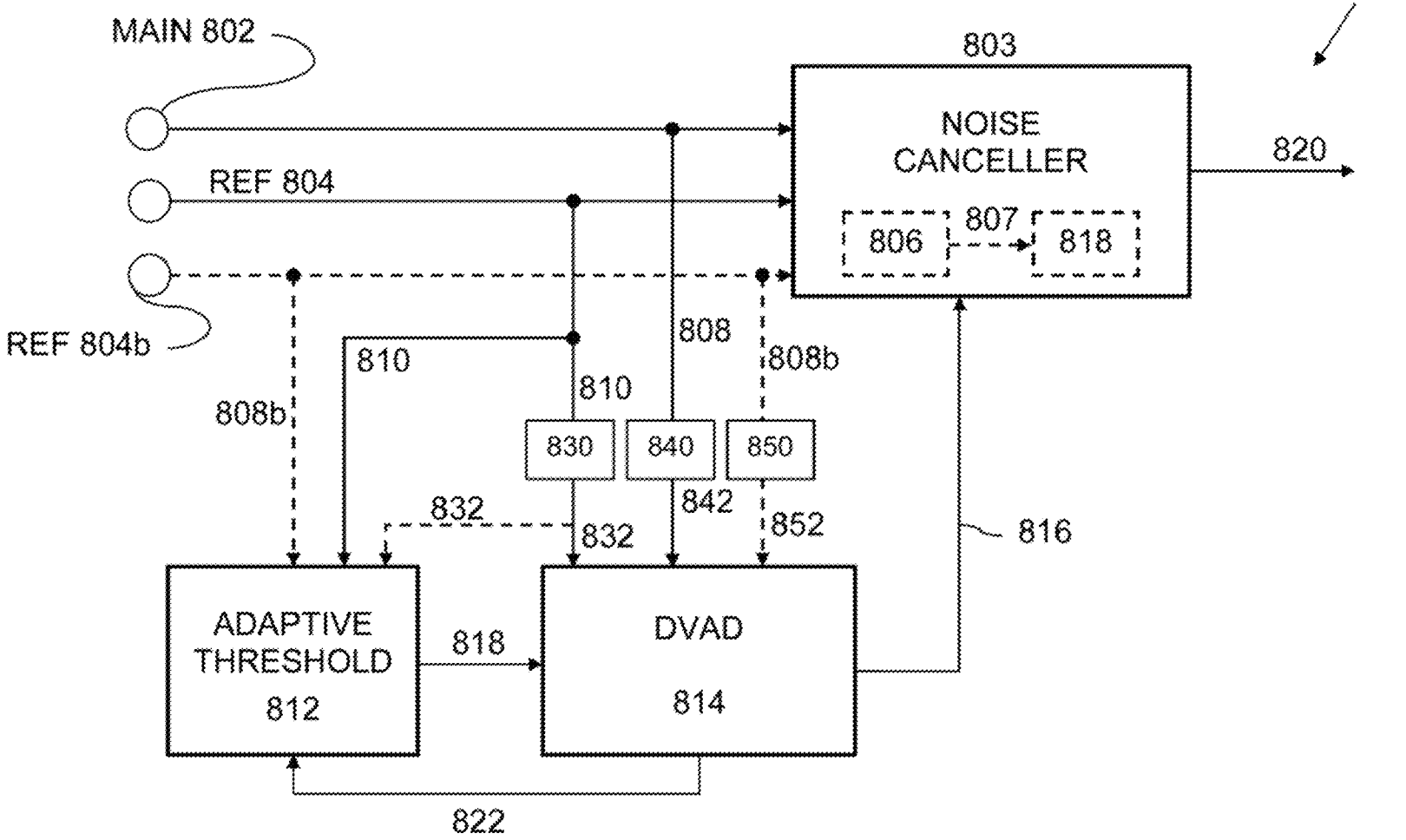
FIG. 8 illustrates another diagram of system architecture, according to embodiments of the invention.

In operation, the threshold offset 610 is provided as described above, for example at 118 (FIG. 1), at 208 (FIG. 2), or at 818 (FIG. 8). Note that the threshold offset 610 will adaptively change in response to an estimated average background noise level as calculated based on the noise received on either the reference microphone or the main microphone channels. The estimated average background noise level was made using the reference microphone channel as described above in FIG. 1 and below in FIG. 8, however in alternative embodiments an estimated average background noise level can be estimated from the main microphone channel.

Figure 7:
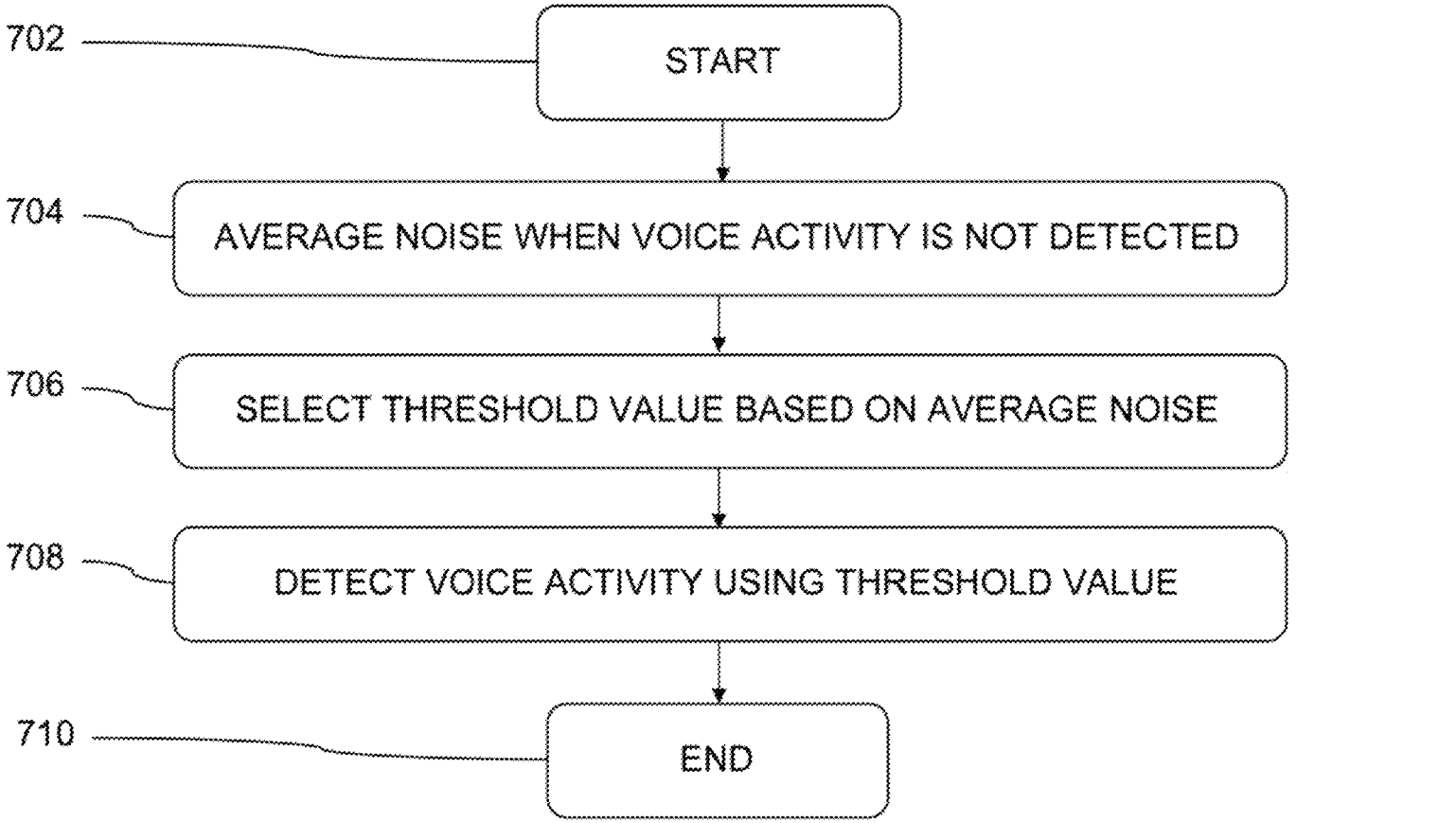
FIG. 7 illustrates a process for providing an adaptive threshold according to embodiments of the invention.

FIG. 7 illustrates, generally at 700, a process for providing an adaptive threshold according to embodiments of the invention. With reference to FIG. 7, a process begins at a block 702. At a block 704 an average background noise level is estimated from either a reference microphone channel or a main microphone channel when voice activity is not detected. In some embodiments, as described above multiple reference channels are used to perform this estimation. In other embodiments, the main microphone channel is used to provide the estimation.

At a block 706 a threshold value (used synonymously with the term threshold offset value) is selected based on the estimated average background noise level computed from the channel used in the block 704.

At a block 708 the threshold value selected in block 706 is used to obtain a signal that indicates the presence of desired voice activity. The desired voice activity signal is used during noise cancellation as described in U.S. Pat. No. 9,633,670 B2, titled DUAL STAGE NOISE REDUCTION ARCHITECTURE FOR DESIRED SIGNAL EXTRACTION, which is hereby incorporated by reference.

FIG. 8 illustrates another diagram of system architecture, according to embodiments of the invention. With reference to FIG. 8, two acoustic channels are input into a noise cancellation module 803. A first acoustic channel, referred to herein as main channel 802, is referred to in this description of embodiments synonymously as a "primary" or a "main" channel. The main channel 802 contains both desired audio and undesired audio. The acoustic signal input on the main channel 802 arises from the presence of both desired audio and undesired audio on one or more acoustic elements as described more fully below in the figures that follow. Depending on the configuration of a microphone or microphones used for the main channel the microphone elements can output an analog signal. The analog signal is converted to a digital signal with an analog-to-digital converter (ADC) (not shown). Additionally, amplification can be located proximate to the microphone element(s) or ADC. A second acoustic channel, referred to herein as reference channel 804 provides an acoustic signal which also arises from the presence of desired audio and undesired audio. Optionally, a second reference channel 804*b* can be input into the noise cancellation module 803. Similar to the main channel and depending on the configuration of a microphone or microphones used for the reference channel, the microphone elements can output an analog signal. The analog signal is converted to a digital signal with an analog-to-digital converter (ADC) (not shown). Additionally, amplification can be located proximate to the microphone element(s) or ADC.

In some embodiments, the main channel 802 has an omni-directional response and the reference channel 804 has an omni-directional response. In some embodiments, the acoustic beam patterns for the acoustic elements of the main channel 802 and the reference channel 804 are different. In other embodiments, the beam patterns for the main channel 802 and the reference channel 804 are the same; however, desired audio received on the main channel 802 is different from desired audio received on the reference channel 804. Therefore, a signal-to-noise ratio for the main channel 802 and a signal-to-noise ratio for the reference channel 804 are different. In general, the signal-to-noise ratio for the reference channel is less than the signal-to-noise-ratio of the main channel. In various embodiments, by way of non-limiting examples, a difference between a main channel signal-to-noise ratio and a reference channel signal-to-noise ratio is approximately 1 or 2 decibels (dB) or more. In other non-limiting examples, a difference between a main channel signal-to-noise ratio and a reference channel signal-to-noise ratio is 1 decibel (dB) or less. Thus, embodiments of the invention are suited for high noise environments, which can result in low signal-to-noise ratios with respect to desired audio as well as low noise environments, which can have higher signal-to-noise ratios. As used in this description of embodiments, signal-to-noise ratio means the ratio of desired audio to undesired audio in a channel. Furthermore, the term "main channel signal-to-noise ratio" is used interchangeably with the term "main signal-to-noise ratio." Similarly, the term "reference channel signal-to-noise ratio" is used interchangeably with the term "reference signal-to-noise ratio."

The main channel 802, the reference channel 804, and optionally a second reference channel 804*b* provide inputs to the noise cancellation module 803. While an optional second reference channel is shown in the figures, in various embodiments, more than two reference channels are used. In some embodiments, the noise cancellation module 803 includes an adaptive noise cancellation unit 806 which filters undesired audio from the main channel 802, thereby providing a first stage of filtering with multiple acoustic channels of input. In various embodiments, the adaptive noise cancellation unit 806 utilizes an adaptive finite impulse response (FIR) filter. The environment in which embodiments of the invention are used can present a reverberant acoustic field. Thus, the adaptive noise cancellation unit 806 includes a delay for the main channel sufficient to approximate the impulse response of the environment in which the system is used. A magnitude of the delay used will vary depending on the particular application that a system is designed for including whether or not reverberation must be considered in the design. In some embodiments, for microphone channels positioned very closely together (and where reverberation is not significant) a magnitude of the delay can be on the order of a fraction of a millisecond. Note that at the low end of a range of values, which could be used for a delay, an acoustic travel time between channels can represent a minimum delay value. Thus, in various embodiments, a delay value can range from approximately a fraction of a millisecond to approximately 500 milliseconds or more depending on the application.

An output 807 of the adaptive noise cancellation unit 806 is input into a single channel noise cancellation unit 818. The single channel noise cancellation unit 818 filters the output 807 and provides a further reduction of undesired audio from the output 807, thereby providing a second stage of filtering. The single channel noise cancellation unit 818 filters mostly stationary contributions to undesired audio. The single channel noise cancellation unit 818 includes a linear filter, such as for example a Wiener filter, a Minimum Mean Square Error (MMSE) filter implementation, a linear stationary noise filter, or other Bayesian filtering approaches which use prior information about the parameters to be estimated. Further description of the adaptive noise cancellation unit 806 and the components associated therewith and the filters used in the single channel noise cancellation unit 818 are described in U.S. Pat. No. 9,633,670, titled DUAL STAGE NOISE REDUCTION ARCHITECTURE FOR DESIRED SIGNAL EXTRACTION, which is hereby incorporated by reference.

Acoustic signals from the main channel 802 are input at 808 into a filter 840. An output 842 of the filter 840 is input into a filter control which includes a desired voice activity detector 814. Similarly, acoustic signals from the reference channel 804 are input at 810 into a filter 830. An output 832 of the filter 830 is input into the desired voice activity detector 814. The acoustic signals from the reference channel 804 are input at 810 into adaptive threshold module 812. An optional second reference channel is input at 808*b* into a filter 850. An output 852 of the filter 850 is input into the desired voice activity detector 814 and 808*b* is input into adaptive threshold module 812. The desired voice activity detector 814 provides control signals 816 to the noise cancellation module 803, which can include control signals for the adaptive noise cancellation unit 806 and the single channel noise cancellation unit 818. The desired voice activity detector 814 provides a signal at 822 to the adaptive threshold module 812. The signal 822 indicates when desired voice activity is present and not present. In one or more embodiments a logical convention is used wherein a "I" indicates voice activity is present and a "0" indicates voice activity is not present. In other embodiments other logical conventions can be used for the signal 822.

Optionally, the signal input from the reference channel 804 to the adaptive threshold module 812 can be taken from the output of the filter 830, as indicated at 832. Similarly, if optional one or more second reference channels (indicated by 804*b*) are present in the architecture the filtered version of these signals at 852 can be input to the adaptive threshold module 812 (path not shown to preserve clarity in the illustration). If the filtered version of the signals (e.g., any of 832, 852, or 842) are input into the adaptive threshold module 812 a set of threshold values will be obtained which are different in magnitude from the threshold values which are obtained utilizing the unfiltered version of the signals. Adaptive threshold functionality is still provided in either case.

Each of the filters 830, 840, and 850 provide shaping to their respective input signals, i.e., 810, 808, and 808*b* and are referred to collectively as shaping filters. As used in this description of embodiments, a shaping filter is used to remove a noise component from the signal that it filters. Each of the shaping filters, 830, 840, and 850 apply substantially the same filtering to their respective input signals.

Figure 10A:
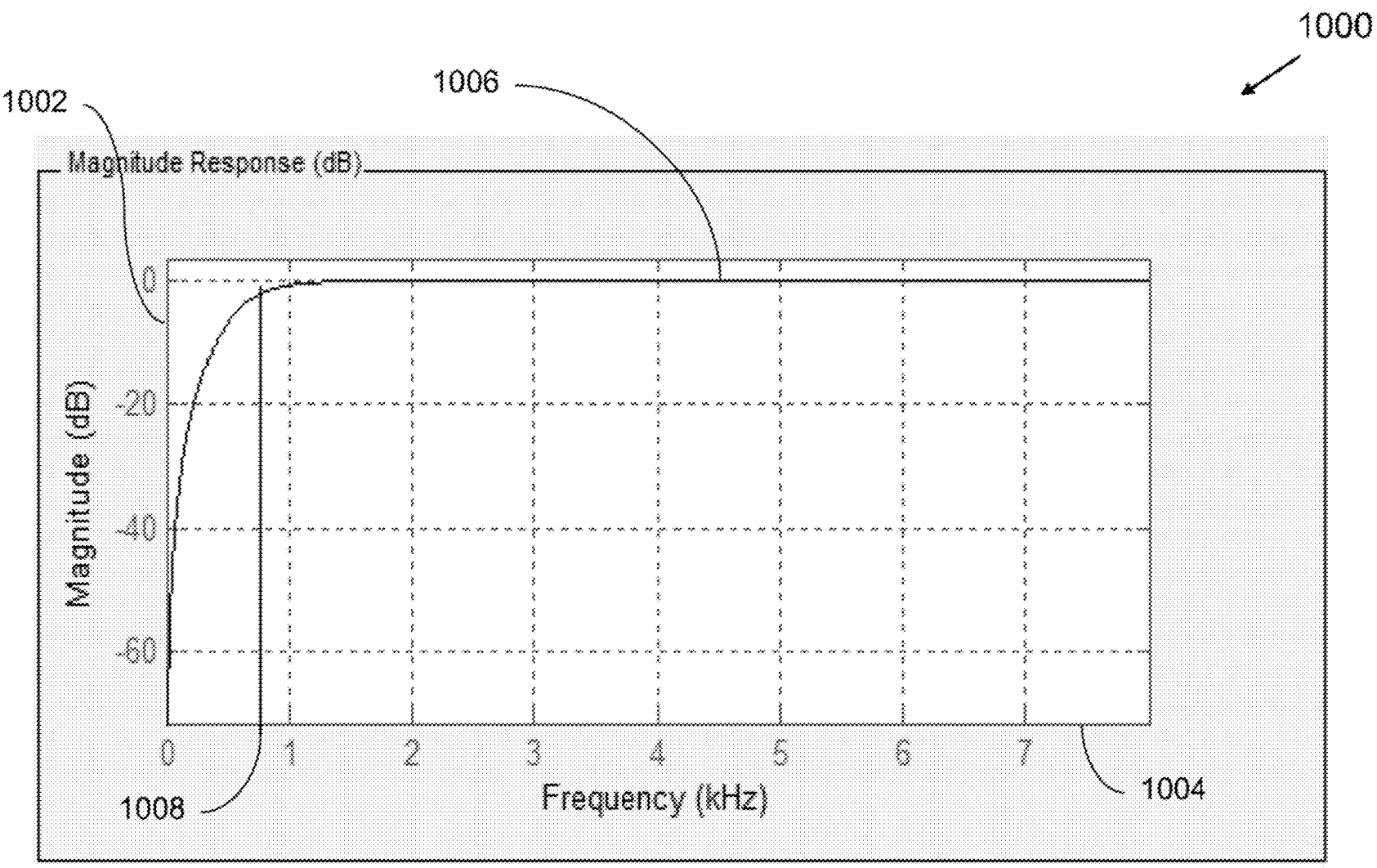
FIG. 10A illustrates a shaping filter response, according to embodiments of the invention.

Filter characteristics are selected based on a desired noise mechanism for filtering. For example, road noise from a vehicle is often low frequency in nature and sometimes characterized by a 1/f roll-off where f is frequency. Thus, road noise can have a peak at low-frequency (approximately zero frequency or at some off-set thereto) with a roll-off as frequency increases. In such a case a high pass filter is useful to remove the contribution of road noise from the signals 810, 808, and optionally 808*b* if present. In one embodiment, a shaping filter used for road noise can have a response as shown in FIG. 10A described below.

In some applications a noise component can exist over a band of frequency. In such a case a notch filter is used to filter the signals accordingly. In yet other applications there will be one or more noise mechanisms providing simultaneous contribution to the signals. In such a case, filters are combined such as for example a high-pass filter and a notch filter. In various embodiments, other filter characteristics are combined to present a shaping filter designed for the noise environment that the system is deployed into.

As implemented in a given data processing system, shaping filters can be programmable so that the data processing system can be adapted for multiple environments where the background noise spectrum is known to have different structure. In one or more embodiments, the programmable functionality of a shaping filter can be accomplished by external jumpers to the integrated circuit containing the filters, adjustment by firmware download, to programmable functionality which is adjusted by a user via voice command according to the environment the system is deployed in. For example, a user can instruct the data processing system via voice command to adjust for road noise, periodic noise, etc. and the appropriate shaping filter is switched in and out according to the command.

The adaptive threshold module 812 includes a background noise estimation module and selection logic which provides a threshold value which corresponds to a given estimated average background noise level. A threshold value corresponding to an estimated average background noise level is passed at 818 to the desired voice activity detector 814. The threshold value is used by the desired voice activity detector 814 to determine when voice activity is present.

In various embodiments, the operation of adaptive threshold module 812 has been described more completely above in conjunction with the preceding figures. An output 820 of the noise cancellation module 803 provides an acoustic signal which contains mostly desired audio and a reduced amount of undesired audio.

The system architecture shown in FIG. 1 can be used in a variety of different systems used to process acoustic signals according to various embodiments of the invention. Some examples of the different acoustic systems are, but are not limited to, a mobile phone, a handheld microphone, a boom microphone, a microphone headset, a hearing aid, a hands free microphone device, a wearable system embedded in a frame of an eyeglass, a near-to-eye (NTE) headset display or headset computing device, any wearable device, etc. The environments that these acoustic systems are used in can have multiple sources of acoustic energy incident upon the acoustic elements that provide the acoustic signals for the main channel 802 and the reference channel 804 as well as optional channels 804*b*. In various embodiments, the desired audio is usually the result of a users own voice. In various embodiments, the undesired audio is usually the result of the combination of the undesired acoustic energy from the multiple sources that are incident upon the acoustic elements used for both the main channel and the reference channel. Thus, the undesired audio is statistically uncorrelated with the desired audio.

Figure 9:
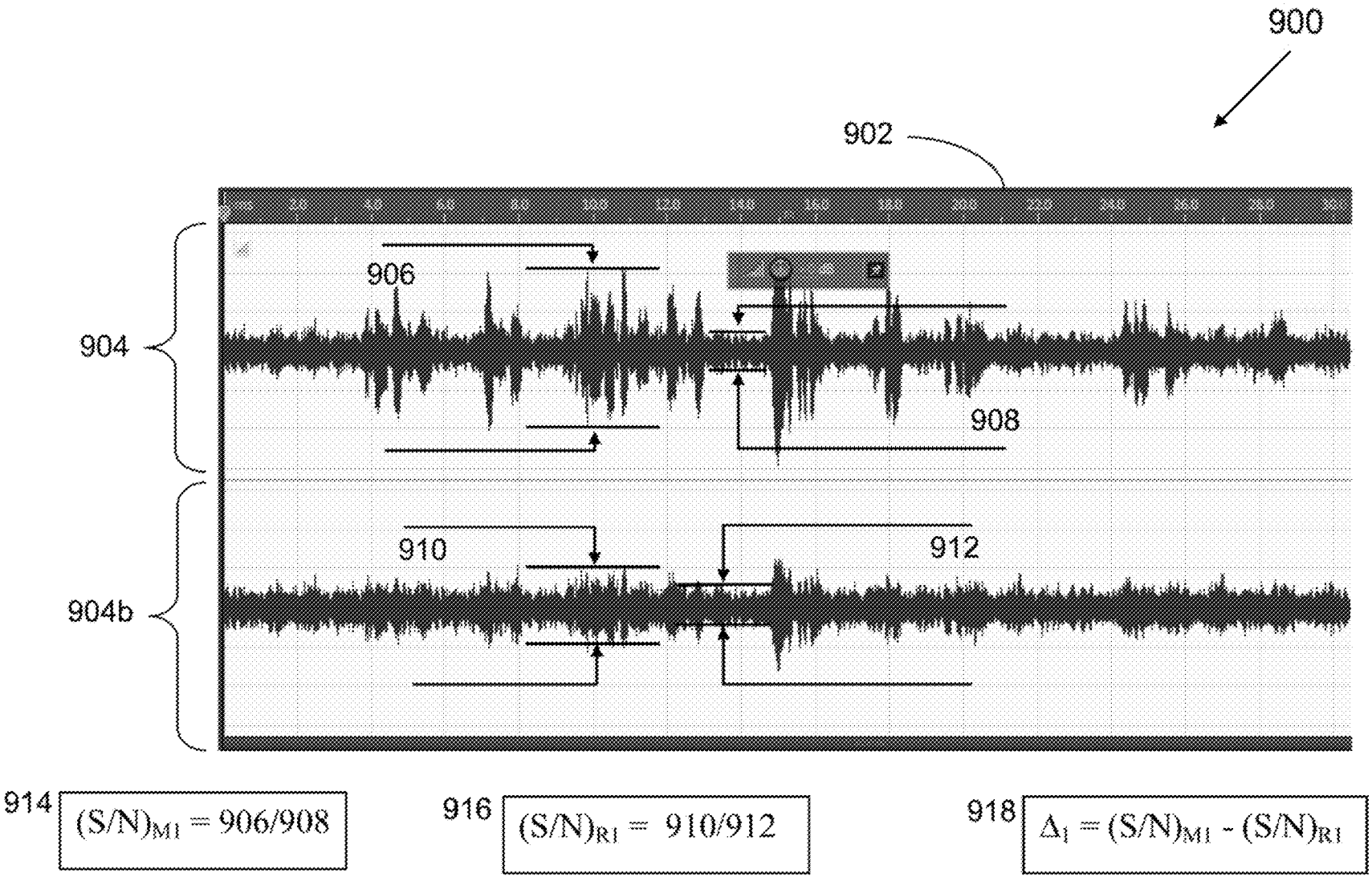
FIG. 9 illustrates desired and undesired audio on two acoustic channels, according to embodiments of the invention.

FIG. 9 illustrates, generally at 900, desired and undesired audio on two acoustic channels, according to embodiments of the invention. With reference to FIG. 9, a time record of a main microphone signal is plotted with amplitude 904 on a vertical axis, a reference microphone signal is plotted with amplitude 904*b* on a vertical axis, and time 902 on a horizontal axis. The main microphone signal contains desired speech in the presence of background noise at a level of 85 dB. The background noise used in this measurement is known in the art as "babble." For the purpose of comparative illustration within this description of embodiments, a signal-to-noise ratio of the main microphone signal is constructed by dividing an amplitude of a speech region 906 by an amplitude of a region of noise 908. The resulting signal-to-noise ratio for the main microphone channel is given by equation 914. Similarly, a signal-to-noise ratio for the reference channel is obtained by dividing an amplitude of a speech region 910 by an amplitude of a noise region 912. The resulting signal-to-noise ratio is given by equation 916. A signal-to-noise ratio difference between these two channels is given by equation 918, where subtraction is used when the quantities are expressed in the log domain and division would be used if the quantities were expressed in the linear domain.

FIG. 10A illustrates, generally at 1000, a shaping filter response, according to embodiments of the invention. With reference to FIG. 10A, filter attenuation magnitude is plotted on the vertical axis 1002 and frequency is plotted on the horizontal axis 1004. The filter response is plotted as curve 1006 having a cut-off frequency (3 dB down point relative to unity gain) at 700 Hz as indicated at 1008. Both the main microphone signal and the reference microphone signals from FIG. 9 are filtered by a shaping filter having the filter characteristics as illustrated in FIG. 10A resulting in the filtered time series plots illustrated in FIG. 11.

Figure 10B:
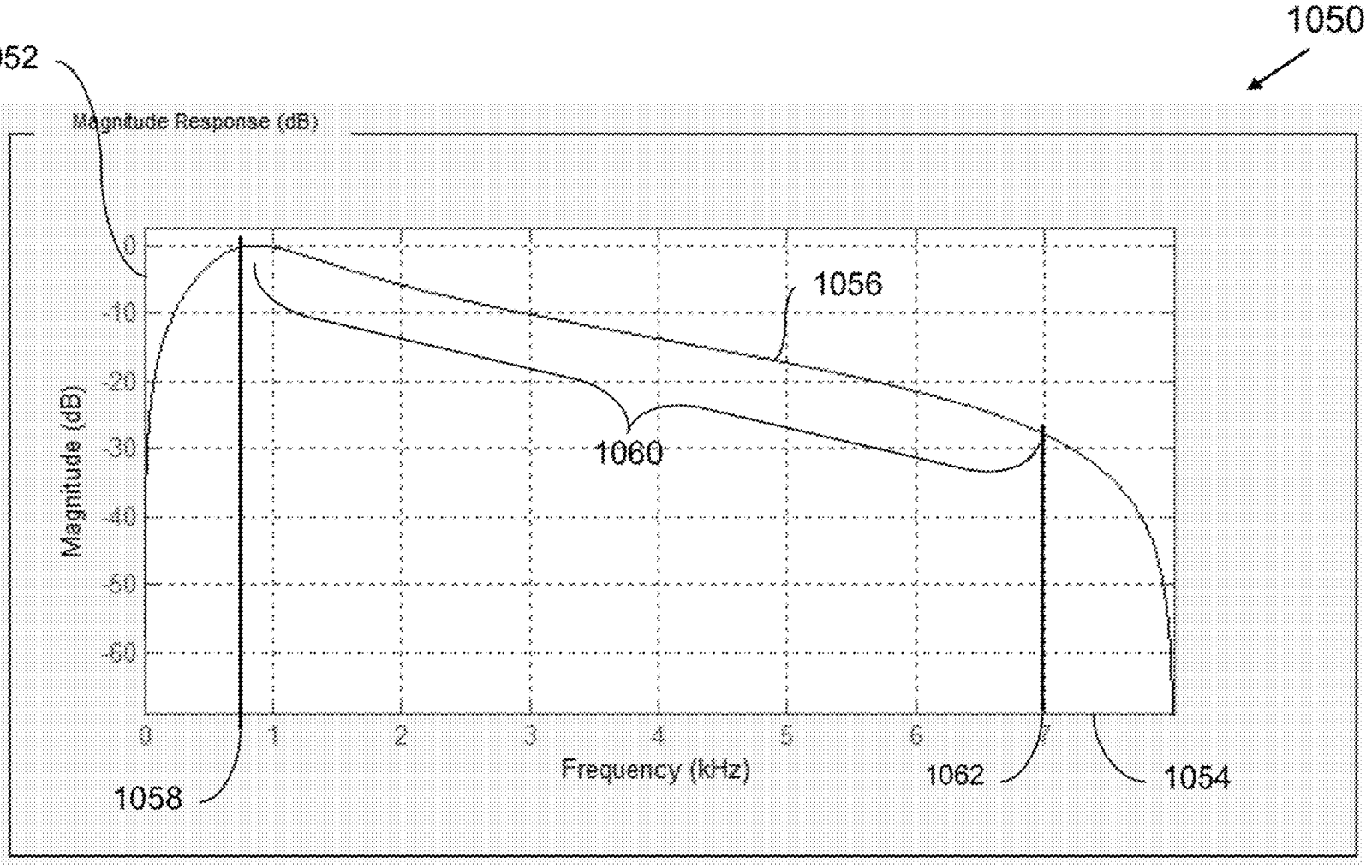
FIG. 10B illustrates another shaping filter response, according to embodiments of the invention.

FIG. 10B illustrates, generally at 1050, another shaping filter response, according to embodiments of the invention. With reference to FIG. 10B, filter attenuation magnitude is plotted on the vertical axis 1052 and frequency is plotted on the horizontal axis 1054. The filter response is plotted as a curve 1056 having a cut-off frequency (3 dB down point relative to unity gain) at 700 Hz indicated at 1058. A roll-off over region 1060 and an upper cut-off frequency at approximately 7 kilohertz (kHz). Thus, multiple filter characteristics are embodied in the filter response illustrated by 1056.

Figure 11:
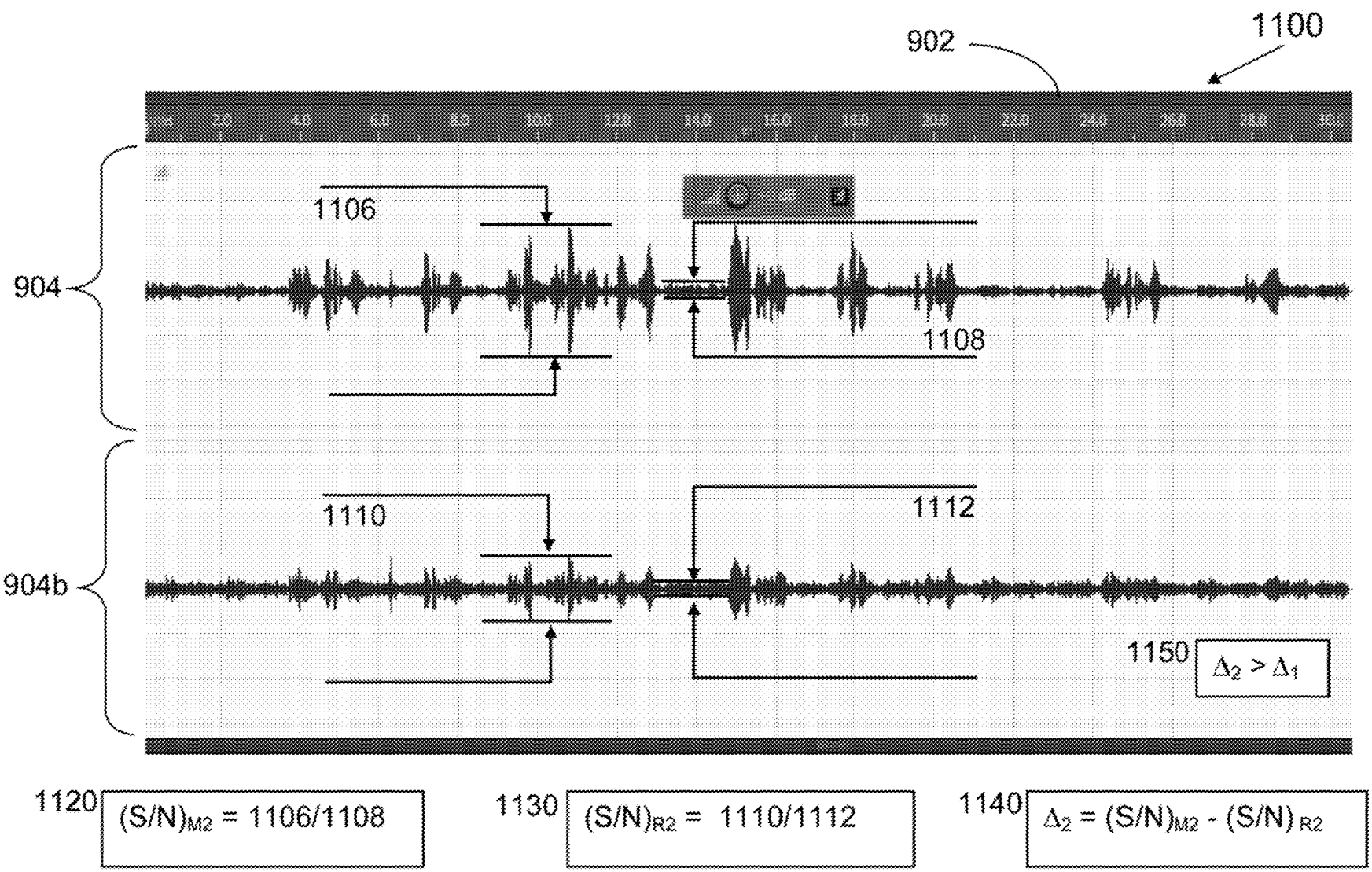
FIG. 11 illustrates the signals from FIG. 9 filtered by the filter of FIG. 10, according to embodiments of the invention.

FIG. 11 illustrates, generally at 1100, the signals from FIG. 9 filtered by the filter of FIG. 10A, according to embodiments of the invention. With reference to FIG. 11, a time record of a main microphone signal is plotted with amplitude 904 on a vertical axis and time 902 on a horizontal axis. The main microphone signal contains desired speech in the presence of background noise at the level of 85 dB (from FIG. 9). As in FIG. 9, for the purpose of comparative illustration within this description of embodiments, a signal-to-noise ratio of the main microphone signal is constructed by dividing an amplitude of a speech region 1106 by an amplitude of a region of noise 1108. The resulting signal-to-noise ratio for the main microphone channel is given by equation 1120. Similarly, a signal-to-noise ratio for the reference channel is obtained by dividing an amplitude of a speech region 1110 by an amplitude of a noise region 1112. The resulting signal-to-noise ratio is given by equation 1130. A signal-to-noise ratio difference between these two channels is given by equation 1140, where subtraction is used when the quantities are expressed in the log domain and division would be used if the quantities were expressed in the linear domain.

Applying a shaping filter as described above increases a signal-to-noise ratio difference between the two channels, as illustrated in equation 1150. Increasing the signal-to-noise ratio difference between the channels increases the accuracy of the desired voice activity detection module which increase the noise cancellation performance of the system.

Figure 12:
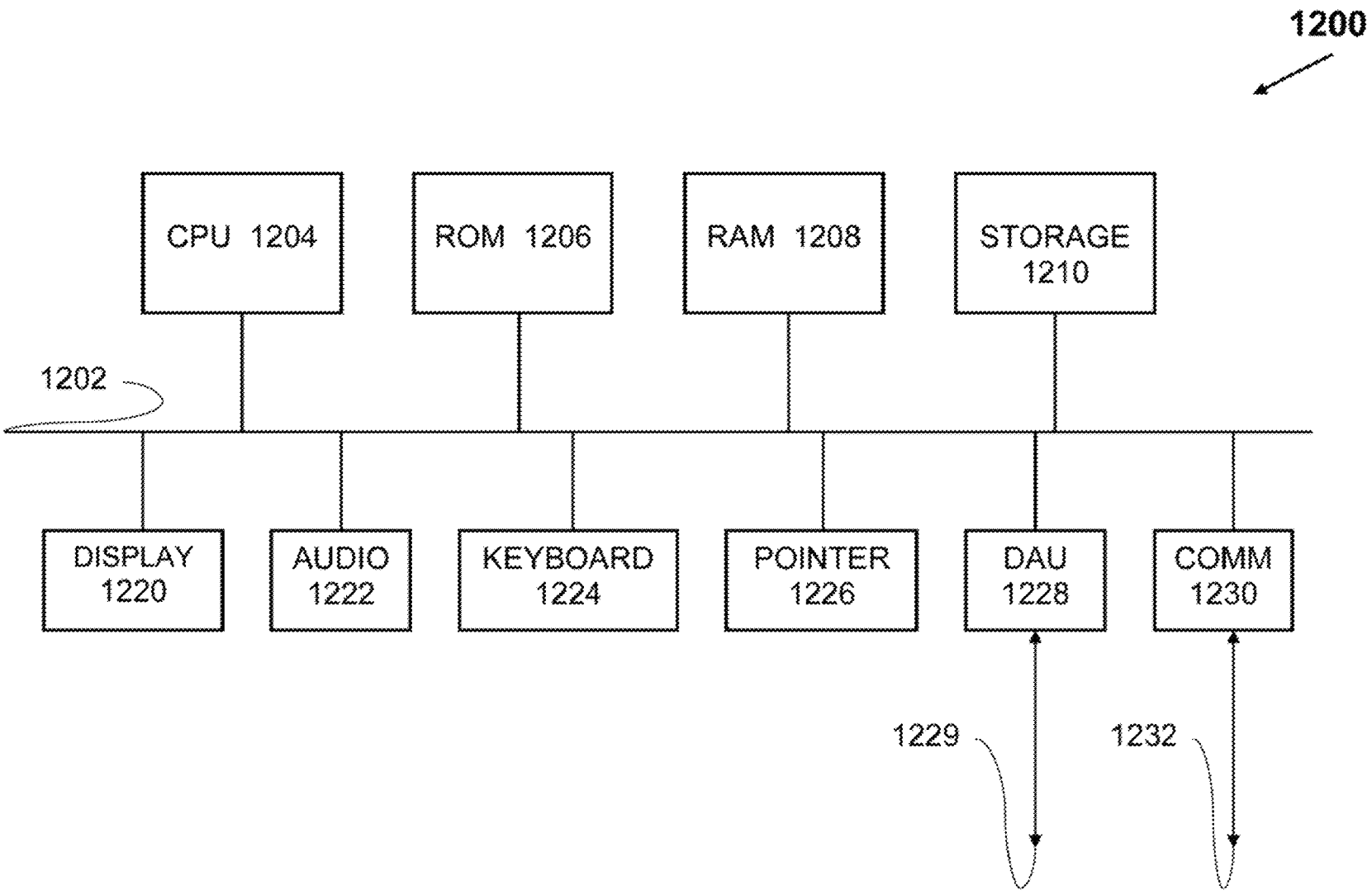
FIG. 12 illustrates an acoustic signal processing system, according to embodiments of the invention.

FIG. 12 illustrates, generally at 1200, an acoustic signal processing system, according to embodiments of the invention. The block diagram is a high-level conceptual representation and may be implemented in a variety of ways and by various architectures. With reference to FIG. 12, bus system 1202 interconnects a Central Processing Unit (CPU) 1204, Read Only Memory (ROM) 1206, Random Access Memory (RAM) 1208, storage 1210, display 1220, audio 1222, keyboard 1224, pointer 1226, data acquisition unit (DAU) 1228, and communications 1230. The bus system 1202 may be for example, one or more of such buses as a system bus, Peripheral Component Interconnect (PCI), Advanced Graphics Port (AGP), Small Computer System Interface (SCSI), Institute of Electrical and Electronics Engineers (IEEE) standard number 1394 (FireWire), Universal Serial Bus (USB), or a dedicated bus designed for a custom application, etc. The CPU 1204 may be a single, multiple, or even a distributed computing resource or a digital signal processing (DSP) chip. Storage 1210 may be Compact Disc (CD), Digital Versatile Disk (DVD), hard disks (HD), optical disks, tape, flash, memory sticks, video recorders, etc. The acoustic signal processing system 1200 can be used to receive acoustic signals that are input from a plurality of microphones (e.g., a first microphone, a second microphone, etc.) or from a main acoustic channel and a plurality of reference acoustic channels as described above in conjunction with the preceding figures. Note that depending upon the actual implementation of the acoustic signal processing system, the acoustic signal processing system may include some, all, more, or a rearrangement of components in the block diagram. In some embodiments, aspects of the system 1200 are performed in software. While in some embodiments, aspects of the system 1200 are performed in dedicated hardware such as a digital signal processing (DSP) chip, etc. as well as combinations of dedicated hardware and software as is known and appreciated by those of ordinary skill in the art.

Thus, in various embodiments, acoustic signal data is received at 1229 for processing by the acoustic signal processing system 1200. Such data can be transmitted at 1232 via communications interface 1230 for further processing in a remote location. Connection with a network, such as an intranet or the Internet is obtained via 1232, as is recognized by those of skill in the art, which enables the acoustic signal processing system 1200 to communicate with other data processing devices or systems in remote locations.

For example, embodiments of the invention can be implemented on a computer system 1200 configured as a desktop computer or work station, on for example a WINDOWS® compatible computer running operating systems such as WINDOWS' XP Home or WINDOWS® XP Professional, Linux, Unix, etc. as well as computers from APPLE COMPUTER, Inc. running operating systems such as OS X, etc. Alternatively, or in conjunction with such an implementation, embodiments of the invention can be configured with devices such as speakers, earphones, video monitors, etc. configured for use with a Bluetooth communication channel. In yet other implementations, embodiments of the invention are configured to be implemented by mobile devices such as a smart phone, a tablet computer, a wearable device, such as eye glasses, a near-to-eye (NTE) headset, or the like.

Algorithms used to process speech, such as Speech Recognition (SR) algorithms or Automatic Speech Recognition (ASR) algorithms benefit from increased signal-to-noise ratio difference between main and reference channels. As such, the error rates of speech recognition engines are greatly reduced through application of embodiments of the invention.

In various embodiments, different types of microphones can be used to provide the acoustic signals needed for the embodiments of the invention presented herein. Any transducer that converts a sound wave to an electrical signal is suitable for use with embodiments of the invention. Some non-limiting examples of microphones are, but are not limited to, a dynamic microphone, a condenser microphone, an Electret Condenser Microphone (ECM), and a microelectromechanical systems (MEMS) microphone. In other embodiments a condenser microphone (CM) is used. In yet other embodiments micro-machined microphones are used. Microphones based on a piezoelectric film are used with other embodiments. Piezoelectric elements are made out of ceramic materials, plastic material, or film. In yet other embodiments, micro-machined arrays of microphones are used. In yet other embodiments, silicon or polysilicon micro-machined microphones are used. In some embodiments, bi-directional pressure gradient microphones are used to provide multiple acoustic channels. Various microphones or microphone arrays including the systems described herein can be mounted on or within structures such as eyeglasses, headsets, wearable devices, etc. Various directional microphones can be used, such as but not limited to, microphones having a cardioid beam pattern, a dipole beam pattern, an omni-directional beam pattern, or a user defined beam pattern. In some embodiments, one or more acoustic elements are configured to provide the microphone inputs.

In various embodiments, the components of the adaptive threshold module, such as shown in the figures above are implemented in an integrated circuit device, which may include an integrated circuit package containing the integrated circuit. In some embodiments, the adaptive threshold module is implemented in a single integrated circuit die. In other embodiments, the adaptive threshold module is implemented in more than one integrated circuit die of an integrated circuit device which may include a multi-chip package containing the integrated circuit.

In various embodiments, the components of the desired voice activity detector, such as shown in the figures above are implemented in an integrated circuit device, which may include an integrated circuit package containing the integrated circuit. In some embodiments, the desired voice activity detector is implemented in a single integrated circuit die. In other embodiments, the desired voice activity detector is implemented in more than one integrated circuit die of an integrated circuit device which may include a multi-chip package containing the integrated circuit.

In various embodiments, the components of the background noise estimation module, such as shown in the figures above are implemented in an integrated circuit device, which may include an integrated circuit package containing the integrated circuit. In some embodiments, the background noise estimation module is implemented in a single integrated circuit die. In other embodiments, the background noise estimation module is implemented in more than one integrated circuit die of an integrated circuit device which may include a multi-chip package containing the integrated circuit.

In various embodiments, the components of the background noise estimation module, such as shown in the figures above are implemented in an integrated circuit device, which may include an integrated circuit package containing the integrated circuit. In some embodiments, the background noise estimation module is implemented in a single integrated circuit die. In other embodiments, the background noise estimation module is implemented in more than one integrated circuit die of an integrated circuit device which may include a multi-chip package containing the integrated circuit.

In various embodiments, the components of the noise cancellation module, such as shown in the figures above are implemented in an integrated circuit device, which may include an integrated circuit package containing the integrated circuit. In some embodiments, the noise cancellation module is implemented in a single integrated circuit die. In other embodiments, the noise cancellation module is implemented in more than one integrated circuit die of an integrated circuit device which may include a multi-chip package containing the integrated circuit.

In various embodiments, the components of the selection logic, such as shown in the figures above are implemented in an integrated circuit device, which may include an integrated circuit package containing the integrated circuit. In some embodiments, the selection logic is implemented in a single integrated circuit die. In other embodiments, the selection logic is implemented in more than one integrated circuit die of an integrated circuit device which may include a multi-chip package containing the integrated circuit.

In various embodiments, the components of the shaping filter, such as shown in the figures above are implemented in an integrated circuit device, which may include an integrated circuit package containing the integrated circuit. In some embodiments, the shaping filter is implemented in a single integrated circuit die. In other embodiments, the shaping filter is implemented in more than one integrated circuit die of an integrated circuit device which may include a multi-chip package containing the integrated circuit.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, waveforms, data, time series or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk read-only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, network PCs, minicomputers, mainframe computers, and the like. The invention can also be practiced in distributed computing environments where tasks are performed by remote processing devices that are linked through a communications network. In other examples, embodiments of the invention as described above in FIG. 1 through FIG. 12 can be implemented using a system on chip (SOC), a Bluetooth chip, a digital signal processing (DSP) chip, a codec with integrated circuits (ICs) or in other implementations of hardware and software.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, mathematical expression, flow diagram or flow chart. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

Non-transitory machine-readable media is understood to include any mechanism for storing information in a form readable by a machine (e.g., a computer). For example, a machine-readable medium, synonymously referred to as a computer-readable medium, includes read only memory (ROM); random access memory (RAM); magnetic disk storage media; optical storage media; flash memory devices; except electrical, optical, acoustical or other forms of transmitting information via propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

Thus, embodiments of the invention can be used to reduce or eliminate undesired audio from acoustic systems that process and deliver desired audio. Some non-limiting examples of systems are, but are not limited to, use in short boom headsets, such as an audio headset for telephony suitable for enterprise call centers, industrial and general mobile usage, an in-line "ear buds" headset with an input line (wire, cable, or other connector), mounted on or within the frame of eyeglasses, a near-to-eye (NTE) headset display, headset computing device or wearable device, a long boom headset for very noisy environments such as industrial, military, and aviation applications as well as a gooseneck desktop-style microphone which can be used to provide theater or symphony-hall type quality acoustics without the structural costs.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An integrated circuit device to provide an adaptive threshold input to a desired voice activity detector (DVAD), comprising:

means for estimating noise when voice activity is not detected by averaging a signal from a microphone to form a particular estimated average background noise level;

a memory, the memory is configured to store at least two threshold values, each threshold value of the at least two threshold values corresponds to a different range of estimated average background noise level, the at least two threshold values were obtained by prior empirical measurements and are stored in the memory; and selection logic, the selection logic to assign the particular estimated average background noise level to a threshold value selected from the at least two threshold values and the selection logic is configured to pass the threshold value to the DVAD, wherein the threshold value was associated with a range of estimated average background noise level during the prior empirical measurements, while the particular estimated average background noise level is within the range, the threshold value is to be used by the DVAD to detect when desired voice activity is present.

2. The integrated circuit device of claim 1, wherein a normalized main signal is compared against a test signal, the test signal includes the threshold value, to detect a presence of desired voice activity.

3. The integrated circuit device of claim 1, wherein a plurality of threshold values are associated with a second range of estimated average background noise levels to provide a threshold value as a function of estimated average background noise level to the desired voice activity detector.

4. The integrated circuit device of claim 1, wherein the signal is to be filtered by a shaping filter, the shaping filter is selected to filter a noise component from the signal thereby increasing a signal-to-noise ratio of the signal before the signal is averaged.

5. The integrated circuit device of claim 1, the means for estimating noise, further comprising:

a buffer, the buffer is electrically coupled to receive the signal;

a signal compressor, the signal compressor is coupled to receive the signal from the buffer and to scale a magnitude of the signal; and a smoothing stage, the smoothing stage reduces high frequency content of the signal.

6. The integrated circuit device of claim 5, wherein the signal compressor applies a compression function selected from the group consisting of log base 10, log base 2, natural log (ln), square root, and a user defined compression function f(x).

7. The integrated circuit device of claim 1, further comprising:

a second signal from a second microphone, when voice activity is not detected, the means for estimating noise to use the second signal and the signal to form a particular estimated average background noise level.

8. The apparatus of claim 1, wherein a functional relationship between threshold values and estimated background noise levels is inverse proportionality.

9. An integrated circuit device utilizing an adaptive threshold desired voice activity detector to control noise cancelation using an integrated circuit, comprising:

means for adapting a threshold value, the threshold value is to be used during voice activity detection;

means for estimating noise, when voice activity is not detected a signal from a microphone is to be averaged to form a particular estimated average background noise level;

logic, the logic to assign the particular estimated averaged background noise level to the threshold value, the threshold value is selected from at least two threshold values, the at least two threshold values were obtained by prior empirical measurements and are stored in memory, each threshold value of the at least two threshold values corresponds to a different range of estimated background noise level;

a first shaping filter, the first shaping filter to filter a reference signal to remove a noise component to provide a filtered reference signal with enhanced signal-to-noise ratio;

a second shaping filter, the second shaping filter to filter a main signal, from a main microphone, to remove the noise component to provide a filtered main signal with enhanced signal-to-noise ratio;

a desired voice activity detector (DVAD), the (DVAD) is configured to receive as an input the threshold value and the filtered main signal, the DVAD utilizes the filtered main signal, normalized by the filtered reference signal, and the threshold value to output a desired voice activity signal with enhanced signal-to-noise ratio difference; and means for cancelling noise, the means for canceling noise is coupled to the DVAD to receive the desired voice activity signal, the desired voice activity signal is to be used to identify desired speech during noise cancellation.

10. The integrated circuit device of claim 9, wherein the first shaping filter and the second shaping filters have programmable filter characteristics.

11. The integrated circuit device of claim 10, wherein the programmable filter characteristics are selected form the group consisting of a low pass filter, a band pass filter, a notch filter, a lower corner frequency, an upper corner frequency, a notch width, a roll-off slope and a user defined characteristic.

12. The apparatus of claim 9, wherein an association between the particular estimated average background noise level and the threshold value was determined by the prior empirical measurements.

13. The apparatus of claim 9, wherein a functional relationship between threshold values and estimated background noise levels is inverse proportionality.

14. A method to operate a desired voice activity detector (DVAD) in an integrated circuit, comprising:

averaging an output signal of a reference microphone channel to provide a particular estimated average background noise level;

selecting a particular threshold value from a plurality of threshold values based on the particular estimated average background noise level, the plurality of threshold values were obtained by prior empirical measurements and are stored in memory, each threshold value of the plurality corresponds to a different range of estimated average background noise level;

passing the particular threshold value to the DVAD; and using the particular threshold value in the DVAD to detect desired voice activity on a main microphone channel while the particular estimated average background noise level is within a range that corresponds to the particular threshold value.

15. The method of claim 14, further comprising:

comparing a normalized main signal against a signal which includes the particular threshold value to detect a presence of desired voice activity.

16. The method of claim 14, further comprising:

filtering frequencies of interest from the output signal with a shaping filter, the shaping filter is selected to filter a noise component from the output signal thereby increasing a signal-to-noise ratio of the output signal before the averaging.

17. The method of claim 14, the averaging further comprising:

accepting the output signal for a period of time;

compressing the output signal; and smoothing the output signal to reduce high frequency content.

18. The method of claim 17, wherein the compressing applies a compression function selected from the group consisting of log base 10, log base 2, natural log (ln), square root, and a user defined compression function f(x).

19. The method of claim 14, wherein the averaging includes utilizing an output signal from a second reference microphone channel to provide the estimated average background noise level.

20. The method of claim 17, wherein the period of time represents one or more frames of data.

21. The method of claim 14, wherein the selecting is based on an association between the particular estimated average background noise level and the threshold value, the association was determined by the prior empirical measurements.

22. The apparatus of claim 14, wherein a functional relationship between threshold values and estimated background noise levels is inverse proportionality.

23. An integrated circuit device to detect desired voice activity, comprising:

means for selecting filter characteristics for a first shaping filter and a second shaping filter, wherein the filter characteristics are selected to eliminate a desired noise component;

a first signal path configured to receive a main microphone signal;

a first shaping filter coupled to the first signal path, the first shaping filter to filter the main microphone signal, wherein the first shaping filter to filter the desired noise component from the main microphone signal to increase a signal-to-noise ratio of the main microphone signal;

a second signal path configured to receive a reference microphone signal;

a second shaping filter coupled to the second signal path, the second shaping filter to filter the reference microphone signal, wherein the second shaping filter to filter the desired noise component from the reference microphone signal to increase a signal-to-noise ratio of the reference microphone signal;

means for estimating noise, an output of the second shaping filter is to be averaged to obtain a particular estimated average background noise level;

selection logic, wherein the selection logic is configured to assign the particular estimated average background noise level to a threshold value selected from at least two threshold values, the at least two threshold values were obtained by prior empirical measurements and are stored in memory, wherein during the prior empirical measurements each threshold value of the at least two threshold values was associated with a range of estimated background noise level; and a desired voice activity detector (DVAD), the DVAD is coupled to an output of the first shaping filter and an output of the second shaping filter, the DVAD to receive the threshold value, the DVAD to form a normalized main signal with increased signal-to-noise ratio, the normalized main signal and the threshold value are to be used during identification of desired voice activity.

24. The integrated circuit device of claim 23, wherein the DVAD to utilize the threshold value to create a desired voice activity signal, and the integrated circuit device, further comprising:

means for cancelling noise, the desired voice activity signal is coupled to the means for canceling noise, the means for canceling noise to use the desired voice activity signal to identify when voice activity is present, wherein a greater degree of noise cancellation accuracy is achieved because of the increased signal-to-noise ratio provided by the shaping filters.

25. The integrated circuit device of claim 23, wherein filter characteristics of the first shaping filter and the second shaping filter are programmable.

26. The integrated circuit device of claim 25, wherein the filter characteristics are selected form the group consisting of a low pass filter, a band pass filter, a notch filter, a lower corner frequency, an upper corner frequency, a notch width, a roll-off slope and a user defined characteristic.

27. The apparatus of claim 14, wherein an association between the particular estimated average background noise level and the threshold value was determined by the prior empirical measurements.

28. The apparatus of claim 23, wherein a functional relationship between threshold values and estimated background noise levels is inverse proportionality.

29. A system to operate a desired voice activity detector (DVAD), comprising:

a data processing system, the data processing system is configured to process acoustic signals; and a computer readable medium containing executable computer program instructions, which when executed by the date processing system, cause the data processing system to perform a method comprising:

averaging an output signal of a reference microphone channel to provide an estimated average background noise level;

selecting a threshold value from a plurality of threshold values based on the estimated average background noise level, the plurality of threshold values were obtained by prior empirical measurements and are stored in memory;

passing the threshold value to the DVAD; and using the threshold value in the DVAD to detect desired voice activity on a main microphone channel.

30. The system of claim 29, the method performed by the data processing system, further comprising:

comparing a normalized main signal against a signal which includes the threshold value to detect a presence of desired voice activity.

31. The system of claim 29, the method performed by the data processing system, further comprising:

filtering the output signal with a shaping filter, the shaping filter is selected to filter a noise component from the output signal thereby increasing a signal-to-noise ratio of the output signal before the averaging.

32. The system of claim 29, the method performed by the data processing system, further comprising:

accepting the output signal for a period of time;

compressing the output signal; and smoothing the output signal to reduce high frequency content.

33. The system of claim 32, wherein the compressing applies a compression function selected from the group consisting of log base 10, log base 2, natural log (ln), square root, and a user defined compression function f(x).

34. The system of claim 29, wherein the averaging includes utilizing a second output signal from a second reference microphone channel to provide the estimated average background noise level.

35. The system of claim 32, wherein the period of time represents one or more frames of data.

36. The system of claim 29, wherein the averaging utilizes an output signal from a main microphone channel to provide the estimated average background noise level instead of the output signal from the reference microphone channel.

37. The system of claim 29, wherein the selecting is based on an association between the estimated average background noise level and the threshold value, the association was determined by the prior empirical measurements.

38. The apparatus of claim 29, wherein a functional relationship between threshold values and estimated background noise levels is inverse proportionality.

* * * * *